US007020964B2

(12) United States Patent
Han et al.

(10) Patent No.: US 7,020,964 B2
(45) Date of Patent: Apr. 4, 2006

(54) NAIL CLIPPER AND NAIL CUTTER, LEVER AND SUPPORTING SHAFT FOR THE SAME

(76) Inventors: Jeong Sik Han, c/o BOCAS Inc., 62-7 Ogeum-Dong, Songpa-Ku, Seoul (KR) 138-856; Gyoung Hee Kim, c/o BOCAS Inc., 62-7 Ogeum-Dong, Songpa-Ku, Seoul (KR) 138-856

( * ) Notice: Subject to any disclaimer, the term of this patent is extended or adjusted under 35 U.S.C. 154(b) by 52 days.

(21) Appl. No.: 10/730,910

(22) Filed: Dec. 10, 2003

(65) Prior Publication Data

US 2004/0111893 A1 Jun. 17, 2004

(30) Foreign Application Priority Data

| | | |
|---|---|---|
| Dec. 10, 2002 | (KR) | 10-2002-0078542 |
| Mar. 31, 2003 | (KR) | 10-2003-0020304 |
| Jun. 10, 2003 | (KR) | 10-2003-0037311 |
| Jul. 18, 2003 | (KR) | 10-2003-0049475 |
| Oct. 30, 2003 | (KR) | 10-2003-0076546 |
| Dec. 4, 2003 | (WO) | PCT/KR2003/02653 |

(51) Int. Cl.
*A45D 29/02* (2006.01)

(52) U.S. Cl. ..... 30/28; 30/125; 132/75.5

(58) Field of Classification Search ..... 30/26, 30/27, 28, 253, 124, 125; 132/73.5, 75.4, 132/75.5, 75.6; 28/60
See application file for complete search history.

(56) References Cited

U.S. PATENT DOCUMENTS

| | | | | |
|---|---|---|---|---|
| 244,891 | A * | 7/1881 | Matz et al. | 30/28 |
| 796,389 | A | 8/1905 | Wright | |
| 806,037 | A | 11/1905 | Wilcox | |
| 1,085,569 | A * | 1/1914 | Casse | 30/28 |
| 2,477,782 | A * | 8/1949 | Bassett | 132/75.5 |
| 2,995,820 | A * | 8/1961 | Pocoski | 30/28 |
| 3,042,047 | A * | 7/1962 | Plaskon | 132/75.5 |
| 3,555,675 | A * | 1/1971 | Jurena | 30/28 |
| 5,226,849 | A * | 7/1993 | Johnson | 30/28 |
| 5,488,772 | A | 2/1996 | Dababneh et al. | |
| 5,832,610 | A * | 11/1998 | Chaplick | 30/28 |
| 5,870,826 | A * | 2/1999 | Lewan | 30/28 |
| 6,173,497 | B1 | 1/2001 | Domenge | |
| 6,523,545 | B1 * | 2/2003 | Rende | 132/75.5 |
| 2002/0092172 | A1 * | 7/2002 | Park | 30/28 |

FOREIGN PATENT DOCUMENTS

| | | |
|---|---|---|
| JP | 57-27204 | 2/1982 |
| JP | 11-169227 | 6/1999 |
| JP | 2002-142853 | 5/2002 |
| WO | 02/39844 | 5/2002 |
| WO | 02/067720 | 9/2002 |

* cited by examiner

*Primary Examiner*—Hwei-Siu Payer
(74) *Attorney, Agent, or Firm*—Buchanan Ingersoll PC

(57) ABSTRACT

A nail clipper of the invention comprises a nail clipper body having a rigidity and a suitable length to grip, and a lever mounted on an upper side of the body and a nail cutter mounted on a lower side of the body through a supporting shaft passing through a supporting shaft hole formed in one side end of the body. When a user grips the cutter, and rotates the cutter centering around the supporting shaft according to using direction, the cutter is rotated at a time within a range of 360° without interference of an obstacle to cut the nail at the desired angle.

34 Claims, 29 Drawing Sheets

NAIL CLIPPER AND NAIL CUTTER, LEVER AND SUPPORTING SHAFT FOR THE SAME

TECHNICAL FIELD

This invention relates to a nail cutter and a nail clipper using the nail cutter for cutting finger nails and/or toenails, and more particularly to a nail clipper comprising a nail clipper body having a rigidity, and a lever mounted on an upper side of the body and a nail cutter mounted on a lower side of the body through a supporting shaft passing through a supporting shaft hole formed in one side end of the body. The supporting shaft directly grips a lower end of the nail cutter while allowing for easily rotating the cutter relative to the body according to using direction, but preventing the cutter from rotating together with the lever upon rotating the lever, and preventing the cutter from freely rotating in use. The rotatable cutter allows for cutting nails at a desired angle by rotating right and left the cutter according to discrete steps, for rotating the cutter by each step of the rotation angle using means for increasing the rigidity and the cutter according to the flexible elastic motion of the cutter. A thin metal plate provides a simple assembling structure of the supporting shaft and the lever, and for removing separation defects of the supporting shaft.

BACKGROUND ART

The prior arts to which a nail clipper of the invention is directed are disclosed in U.S. Pat. No. 6,173,497, Japanese Patent Laid-Open Publication No. (Hei) 11-169227 (Jun. 29, 1999), U.S. Pat. No. 796,389, U.S. Pat. No. 806,037, U.S. Pat. No. 5,488,772, Japanese Utility Model Laid-Open Publication No. (Sho) 57-27204 (Feb. 12, 1998), International Publication No. WO 02/067720, and International Publication No. WO 02/39844 (counterpart application: Japanese Patent Laid-Open Publication No. 2002-142853).

U.S. Pat. No. 6,173,497, which is related a rotation operating structure of a nail cutter applied to the invention, discloses a constitution that a jaw is connected to handles through hooked ends, and the jaw is rotated from the handles. However, according to the nail clipper of that invention, there is an inconvenience in that the two handles should be folded and unfolded upon use. Further, since the nail clipper has no structure for setting an angle of the cutter, there is no means for preventing the cutter from easily and freely being rotated upon using. Furthermore, in case that the jaw is made of a single piece construction, there is no means for making a flexible elasticity or for reinforcing rigidity. Also, since both levers are constituted to face each other at both sides when closing the jaw up and down, there has been an inconvenience for manipulating the rotation of the jaw.

A first embodiment of Japanese Patent Laid-Open Publication No. (Hei) 11-169227 discloses a cutter or a jaw constituted to be rotated by a desired angle. However, since the cutter is inserted between an upper plate and a lower plate of a supporting member or a body, there has been an inconvenience that, upon rotating the cutter, a user pushes the cutter from the body using a finger, and then manipulates again the cutter to adjust to a desired revolution angle. Meanwhile, according to a second embodiment, since a lower part of the cutter is opened, the cutter can be directly rotated. However, since a rear end of the cutter is coupled to the body by a rivet, the rotation movement is not easily made. Further, if a user uses the nail clipper with the cutter rotated, since the user presses the lever with the body and the lever crossed each other, there have been drawbacks that the pressing motion is unnatural, and a force for cutting a nail is deflected.

U.S. Pat. No. 796,389 and U.S. Pat. No. 806,037 commonly comprise a cutter and a lever for manipulating the cutter. According to a structure of the cutter, since the cutter is made by simply bending a plate and forming a cutting blade of a front end thereof, a rigid structure of the cutter or an elastic flexible operation structure of the cutter is not disclosed. In such a case, there have been problems as follows.

In case of biting motion (motion for cutting a nail) of both blades by manipulating a lever, since the cutter is very thin, and thus has a weak rigidity, the cutter is bent, whereby the cutting force is weakly transferred. To prevent this, a plate thickness of the cutter should be increased. However, in such a case, since a center portion of the bent part becomes rigid, and thus a motion for pressing the cutter is not smooth, and a manipulation of the lever becomes difficult. Therefore, if the force for pressing the cutter is directly transferred to a blade portion, and acts as a shearing force, means for having opposite properties that the cutter should have a rigidity and a flexible elastic force is requested.

According to U.S. Pat. No. 5,488,772, a cutter has a sidewall projected from one side thereof. However, since this constitution is only for supporting a pin of a lever, and it is not for a reinforcing structure, the above problems discussed above with reference to U.S. Pat. No. 796,389 and U.S. Pat. No. 806,037 still remains.

According to Japanese Utility Model Laid-Open Publication No. (Sho) 57-27204, upper and lower cutters have sidewalls at both sides thereof for the purpose of preventing a cut nail from scattering, respectively. However, since this constitution does not suggest a means for providing flexible elasticity, it is not practically used.

Further, International Publication No. WO 02/067720 discloses a nail clipper having a cutter, and a lever for manipulating the cutter, but this constitution is not for rotating the cutter. Meanwhile, the cutter comprises an elastic part constituted by penetrating a circle hole in a center of a bent plate member, and a rigid part having a wide width and a slightly bent shape. However, in such a case, there have been problems as follows. In the process of manufacturing a nail clipper, a cutter has a high hardiness through a heat treatment process for endurance of a blade after a press process. In case of forming the upper and lower cutters by bending a center portion of the cutter, which is made of the material described above, having a short length, a stress pressing repeatedly upon using is concentrated upon the center portion of the bent part, specifically, the narrowest portion of the center portion. Thus, a breakage is easily generated, whereby the nail clipper cannot be used. According to the claims of that invention, number and size of hole requested for a proper resilience may be adjusted. Thus, this means that a proper resilience is provided. However, since the method for widely dispersing the repeated stress is not suggested, the breakage of the cutter due to the stress concentration phenomenon cannot be prevented. Further, in order to maintain a rigid section, a resilient section is extremely limited on the center portion of the bent part by forming a reinforcing rib between the center portion of the bent part and a wide end section. Thus, since a stress for making a biting motion (motion for cutting a nail) by folding the upper and lower cutters is concentrated upon a remaining portion of the minimum width centering around a hole of the bent part, there has been a problem that the expected life span of the cutter is considerably reduced.

Meanwhile, the prior art to which a hinge structure of a lever applied to the nail clipper of the invention is directed is disclosed in International Publication No. WO 02/39844. According to the nail clipper disclosed in International Publication No. WO 02/39844, oppositely disposed projections are a concave part formed with both side arms of the lever, a supporting shaft has a hooking groove formed by cutting off a part of both sides of an upper end of a cylinder, and the both projections serves to pulling the supporting shaft through leverage by assembling into the hooking grooves of the upper end of the cylinder. In such a case, a tension applied to the supporting shaft and the projection of the lever by leverage of the lever acts as a lateral force for biasing the projection toward the arm part, both arm parts are widened relative to each other, and thus there is a concern that they will be separated from the supporting shaft. Further, since the supporting shaft has the hooking groove formed by cutting off a part of both sides of an upper end of a cylinder, since, in case of enlarging the hooking groove, a remaining thickness of the cylinder should be reduced, the hooking groove cannot be enlarged, and thus the hooking part becomes considerably more fragile. In such a case, the projection of the lever can be separated from the supporting shaft even with some breakage or wear. This concern is greater when the lever is made of a plastic material.

DISCLOSURE OF INVENTION

In order to resolve the above problems, exemplary embodiments of the invention to provide a nail clipper comprising a nail clipper body having a rigidity, and a lever mounted on an upper side of the body and a nail cutter mounted on a lower side of the body through a supporting shaft passing through a supporting shaft hole formed in one side end of the body for directly gripping a lower end of the nail cutter and easily rotating the cutter form the body according to using direction, for preventing the cutter from rotating together with the lever upon rotating the lever, for preventing the cutter from freely rotating in use, and for cutting nails at a desired angle by rotating right and left the cutter according to each step.

Further, it is another object of the invention to provide a nail clipper for preventing an a connecting part between the upper and lower cutters of a cutter from breaking by a flexible elastic structure and a structure for preventing stress concentration in the connecting part, for easily cutting nails so that a pressing force is directly transferred to the cutter without a loss of the pressing force by providing both sides of the cutter with a non-elastic rigid section through a reinforcing rib, and for preventing nail cut from scattering outside.

Further, it is another object of exemplary embodiments of the invention to provide a nail clipper comprising a coupling structure of a lever and a supporting shaft, wherein a projection shaft is reached in safe upon a head part via a divided surface of the supporting shaft, the projection shaft is fitted to a supporting shaft holes of a body and the cutter, a wedge is inserted and fixed between the divided surfaces, and the divided surfaces of the supporting shaft are widened each other, whereby a hooking jaw of a lower portion of the supporting shaft is engaged with a lower surface of the cutter.

To accomplish the above objects of exemplary embodiments of the invention, a nail clipper according to the invention comprises a nail clipper body having a rigidity and a suitable length to grip, the nail clipper body having a supporting shaft hole at one side thereof; a nail cutter having opposite cutting blades, and an upper cutter and a lower cutter facing each other, having a supporting shaft hole adjacent to the cutting blade, respectively, and having rigid and elastic property; and a lever positioned on an upper side of the nail clipper body and connected with the cutter and the body through a supporting shaft to move the cutter by leverage; wherein the lever is positioned on an upper side of the nail clipper body, and the nail cutter is positioned on a lower side of the nail clipper body, whereby, the cutter is rotatable within a range of 360° without interference of an obstacle, when the cutter is rotated centering around the supporting shaft with an unrestrained state.

Further, a nail cutter according to the invention comprises opposite cutting blades formed in one side end thereof; and an upper cutter and a lower cutter facing each other, having a supporting shaft hole adjacent to the cutting blade, respectively, and having a rigid section and an elastic section by bending the other side thereof; the rigid section having a rigidity reinforcing means having a predetermined length at both side ends of the cutter and preventing the cutter from getting bent by transformation through bending or pressing so that a force pressed to the cutter is transferred into a cutting force without loss of force; the elastic section having a breakage preventing and elastic flexible means for preventing a breakage of the cutter and simultaneously for securing a flexible elastic property by dispersing a stress concentration due to pressing stress.

Further, a lever for a nail clipper is characterized in that a concave part is formed on one end thereof, in that an opposite respective projection shaft and a supporting shaft having a stepped portion against the projecting shaft for preventing both projecting shafts from widening by connecting ends of the both projecting shafts with a shaft are formed on the opposite surface of the concave part, in that a lever fulcrum part is formed adjacent to the concave part, and in that a pressing part is extended to the other end thereof.

Further, a supporting shaft for a nail clipper is characterized in that a head part is formed in one end thereof, the head part having a hole in the center thereof, in that a pair of posts are formed by being divided and longitudinally extended from the hole to both directions, in that a wedge hooking projection is formed on the respective divided surface of the post, in that a hooking jaw is formed to be projected outside at a lower end thereof, and in that the supporting shaft comprises a wedge having a hooking hole for engaging with the wedge hooking projection by fitting between the divided surfaces.

According to the assembling process of the invention, to begin with, the head part of the supporting shaft is engaged with the projection shaft of the lever. Then, the supporting shaft is fitted into the supporting shaft holes of the body and the cutter. Then, if the wedge is inserted between the divided surfaces of the supporting shaft, the divided surfaces is widened, whereby the hooking jaw of the bottom part of the supporting shaft and the bottom surface of the cutter are hooked and coupled each other.

BRIEF DESCRIPTION OF DRAWINGS

The above and other objects, features and advantages of the invention will be apparent from the following detailed description of the preferred embodiments of the invention in conjunction with the accompanying drawings, in which.

BEST MODE FOR CARRYING OUT THE INVENTION

Figure 1:
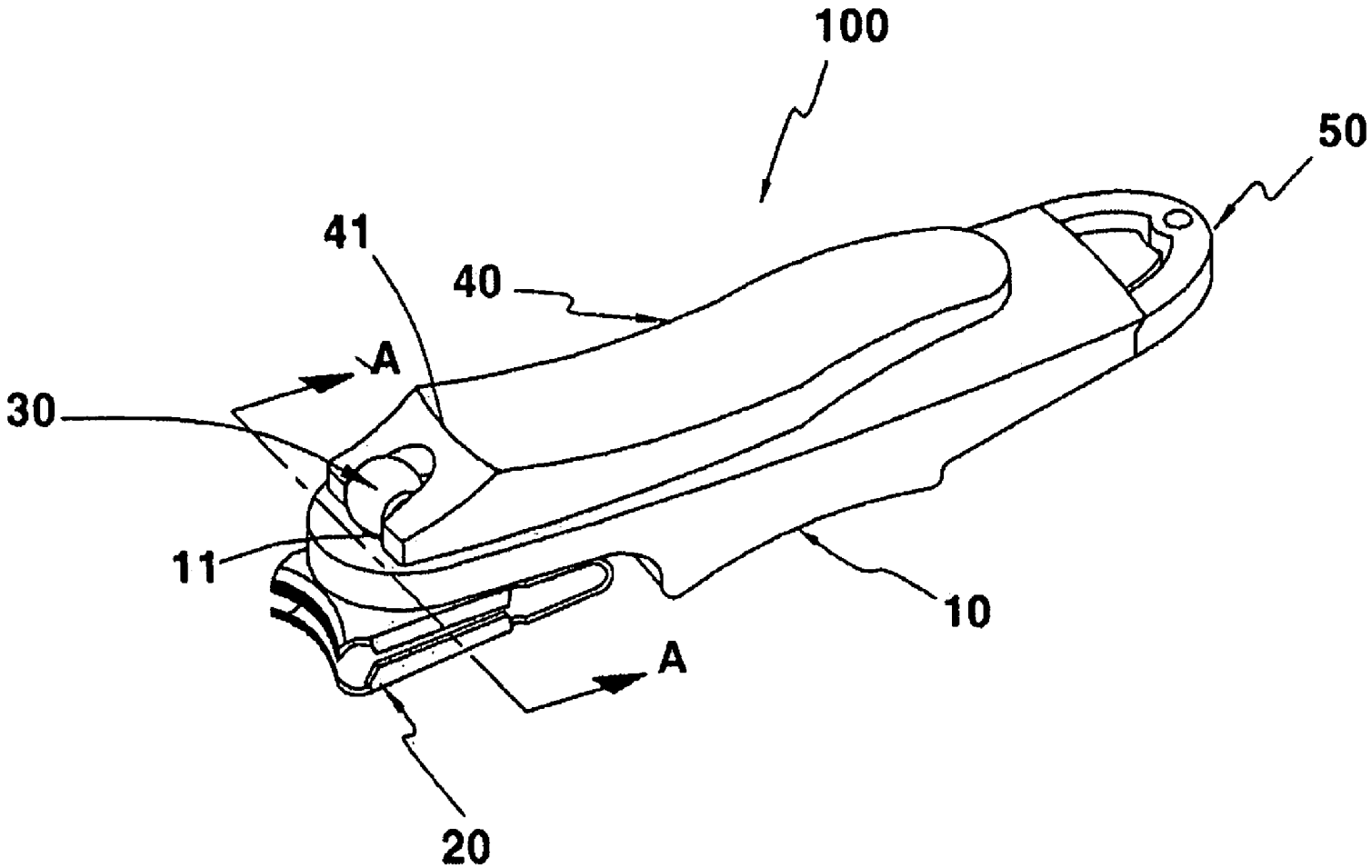
FIG. 1 is a perspective view of a nail clipper according to an exemplary embodiment of the invention.
Figure 2A:
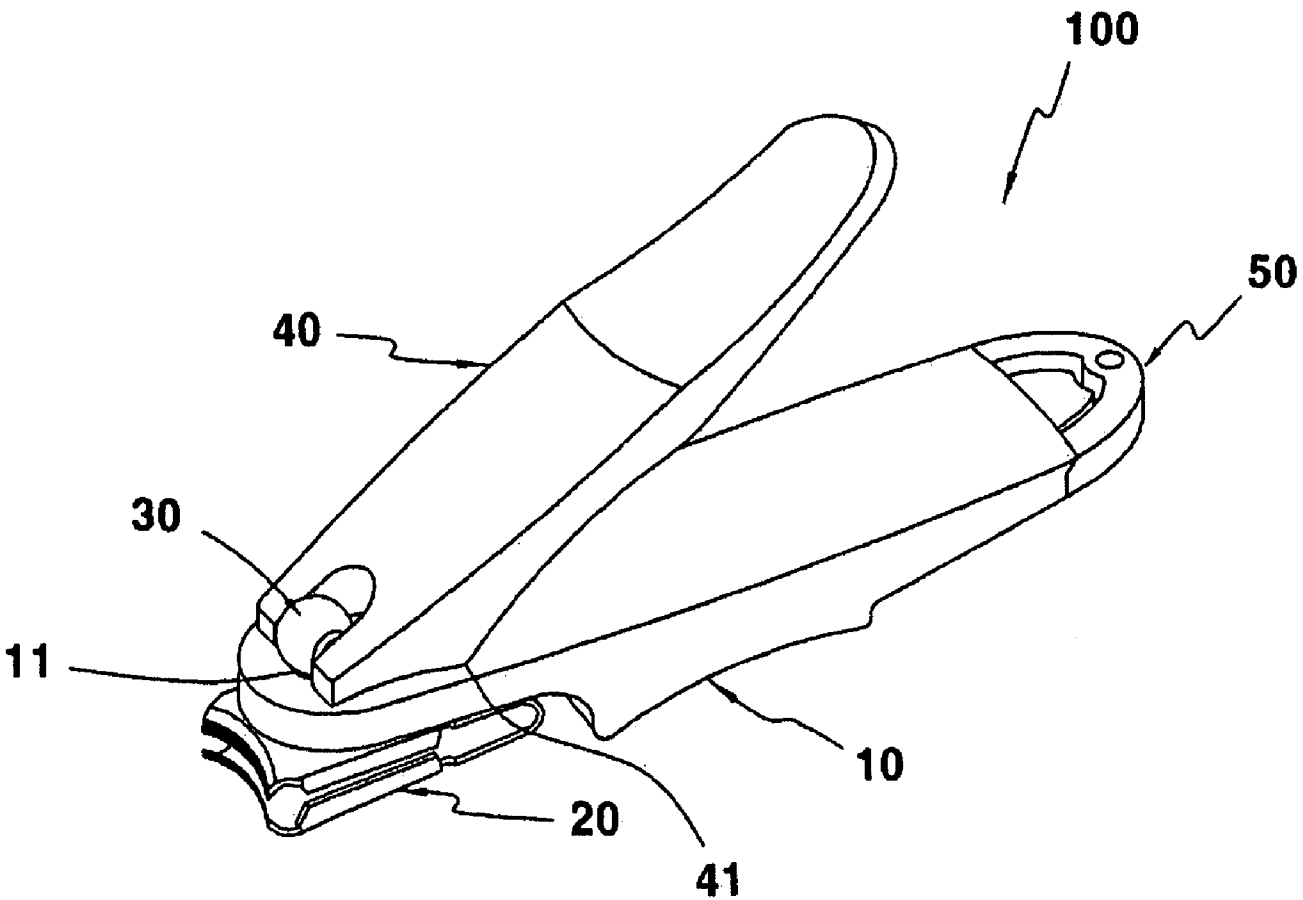
FIG. 2*a* is a perspective view of the state of raising a lever of a nail clipper according to an embodiment of the invention.
Figure 2B:
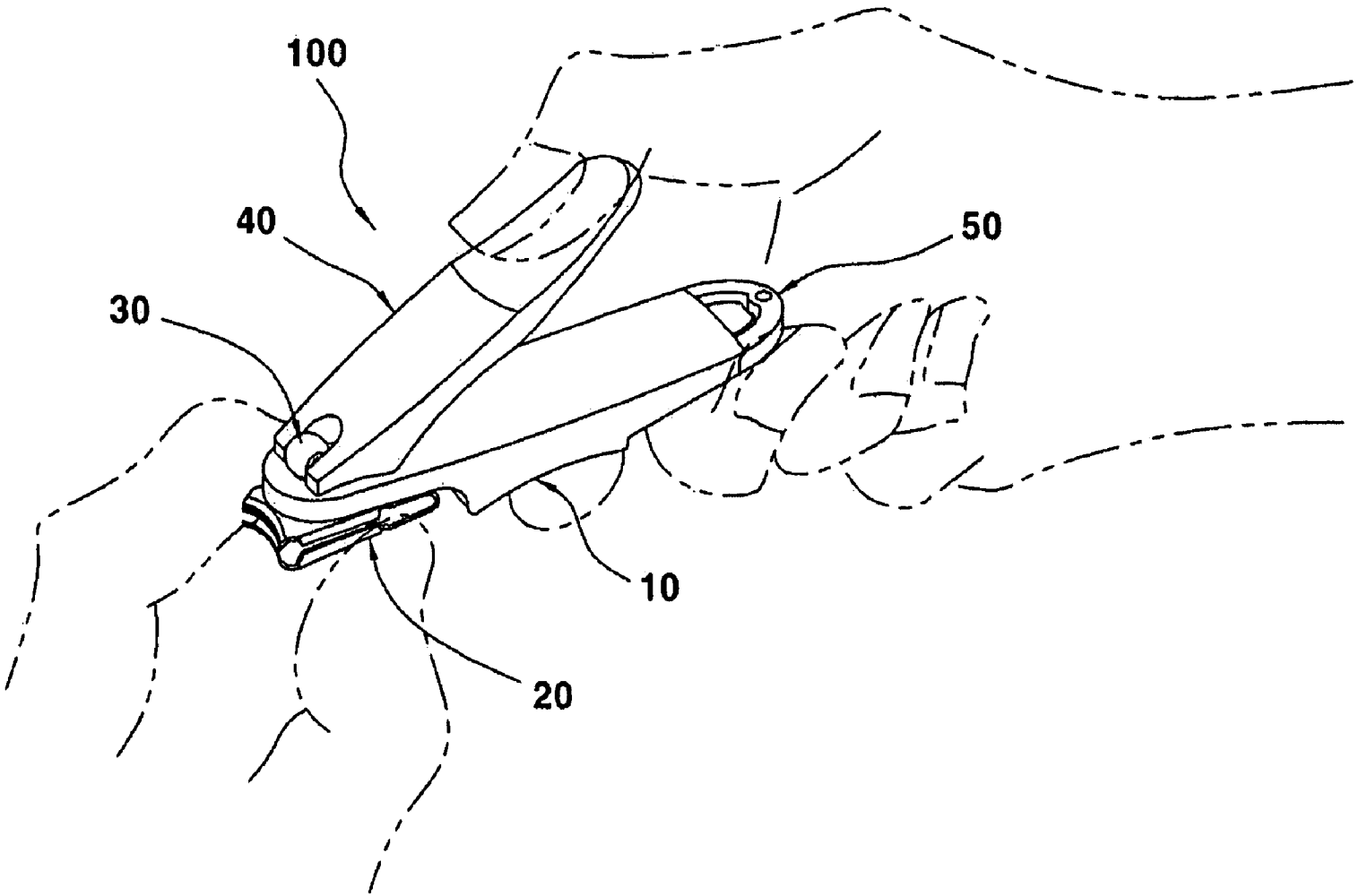
FIG. 2*b* is a view for showing the state of preparing for a use of a nail clipper of the invention.
Figure 3A:
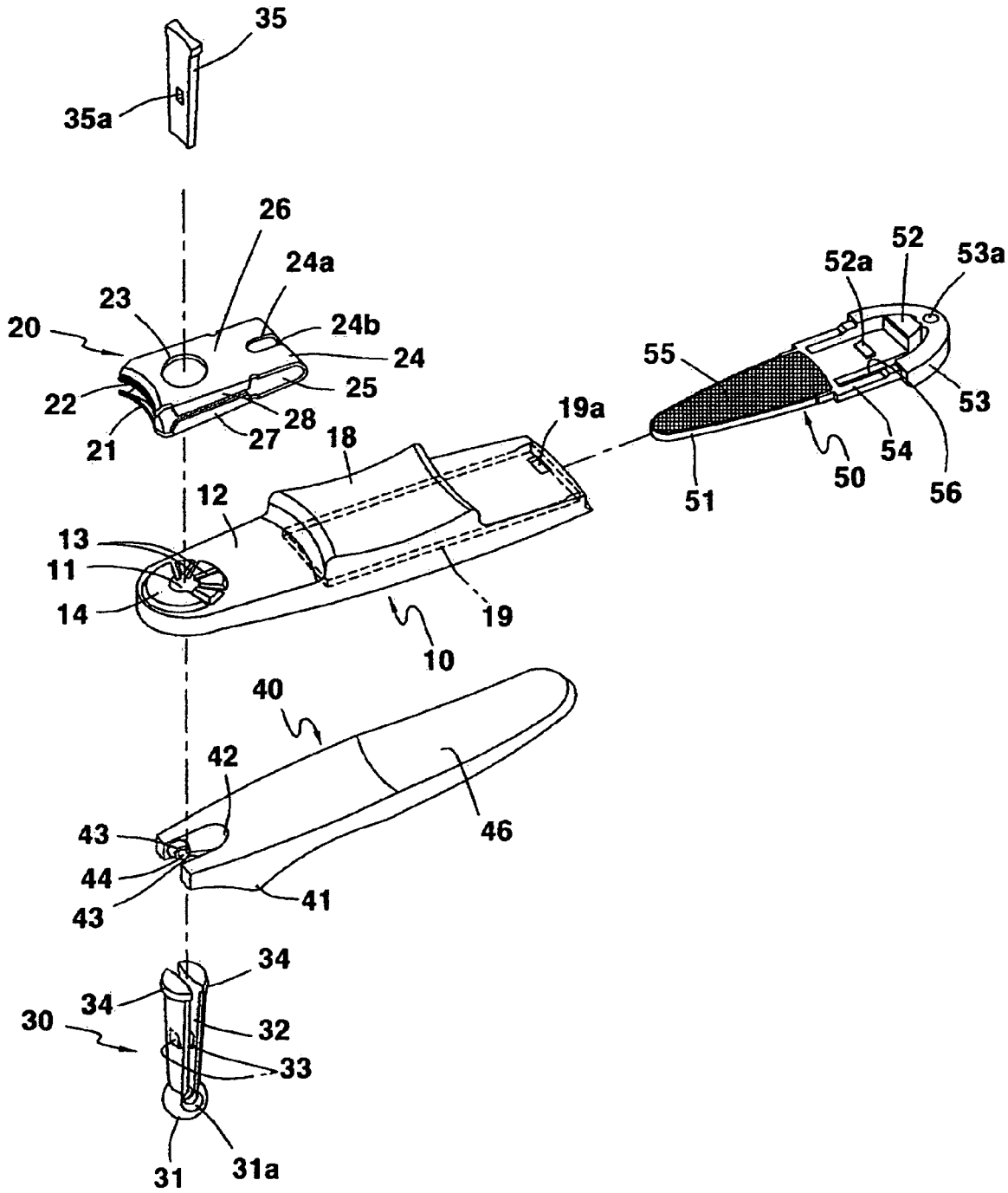
FIG. 3*a* is an exploded perspective view of a nail clipper according to an embodiment of the invention.
Figure 3B:
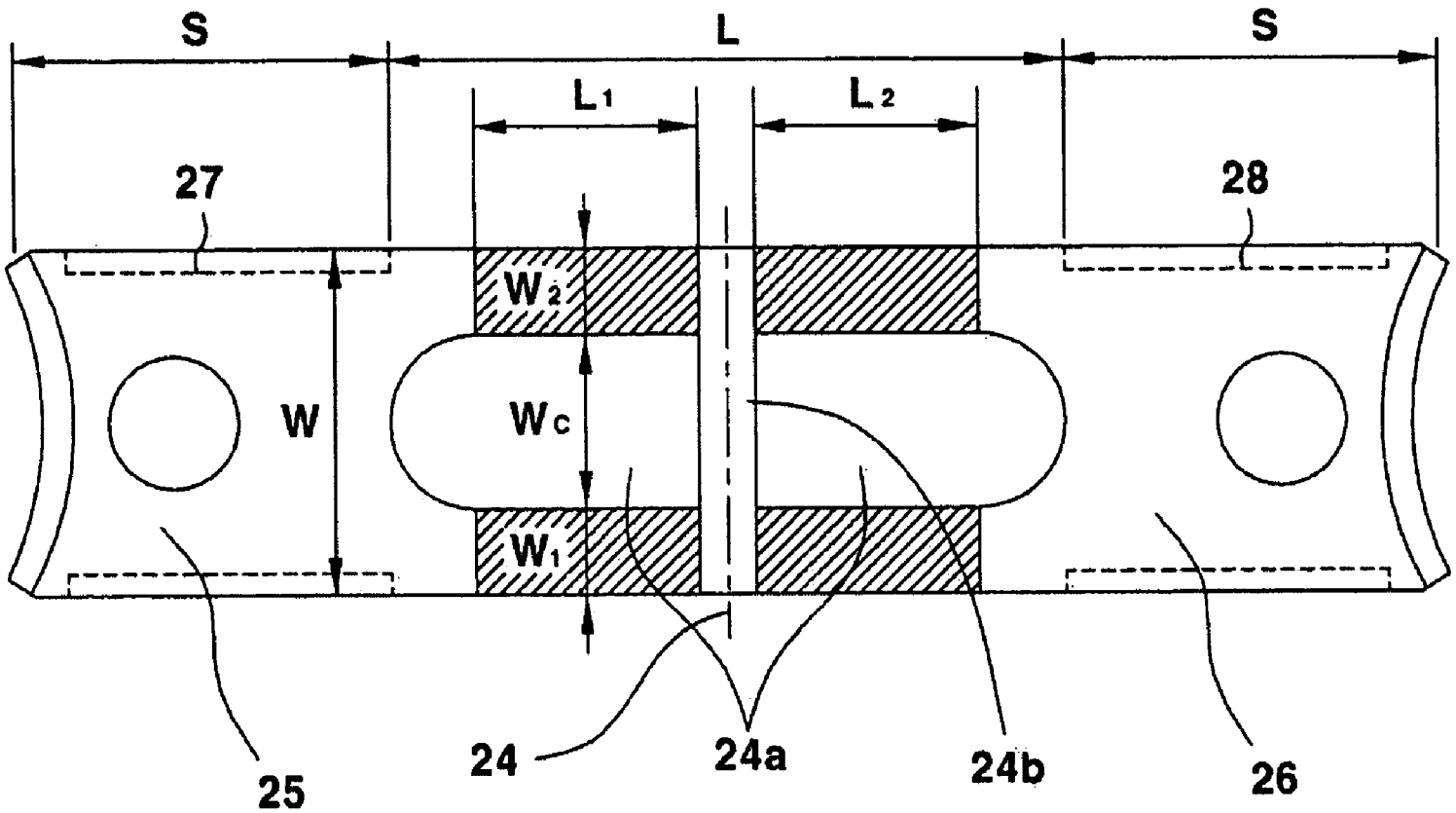
FIG. 3*b* is a view of a state unfolding a bent center part for showing a rigid section and an elastic section of a nail cutter of a nail clipper applied to the invention.
Figure 3C:
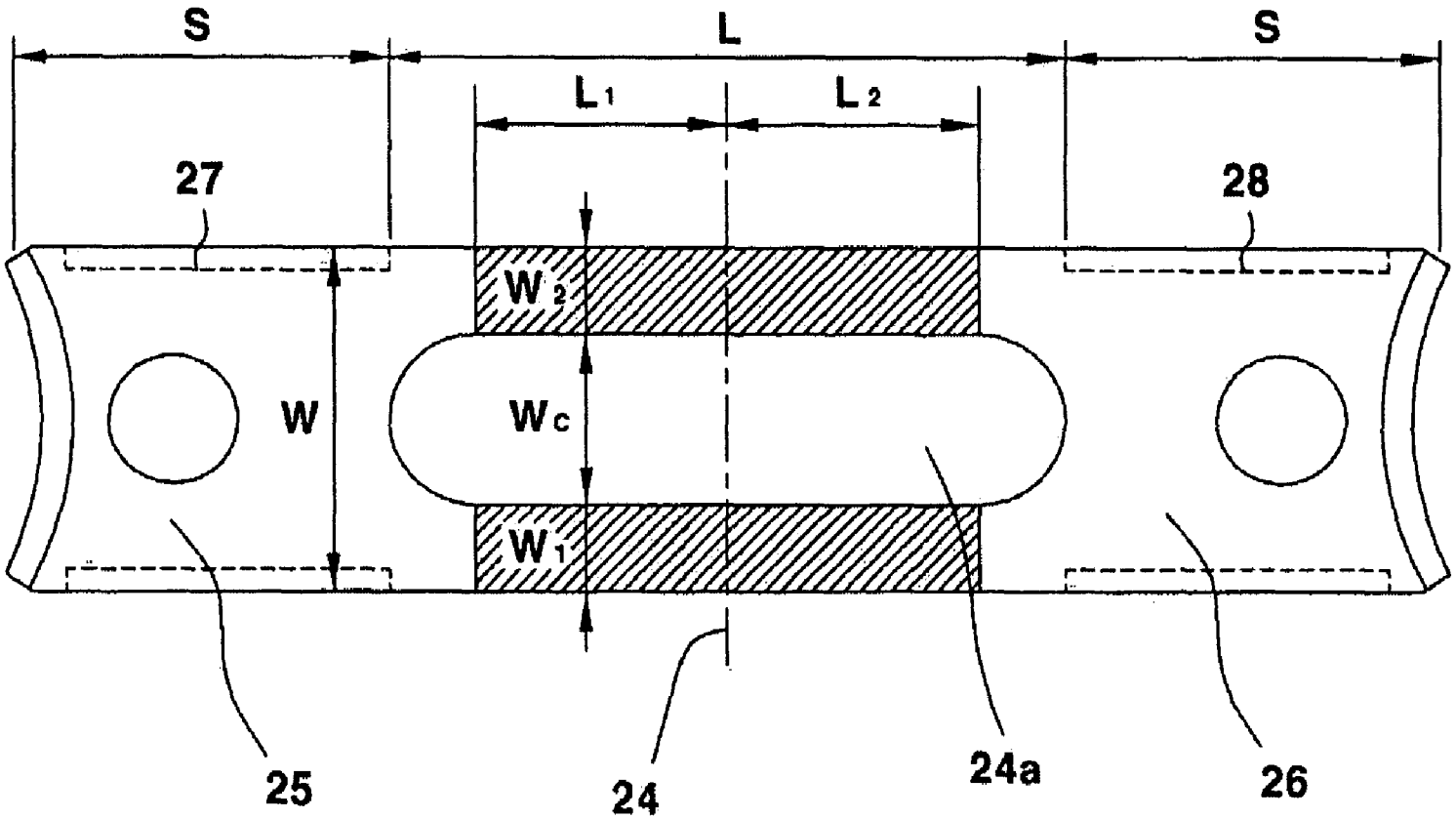
FIG. 3*c* is a view of a state unfolding a bent center part for showing the other modifications of the nail cutter illustrated in FIG. 3*b;*

FIG. 1 is a perspective view of a nail clipper 100 according to an embodiment of the invention, FIG. 2*a* is a perspective view of the state of raising a lever 40 of a nail clipper according to an embodiment of the invention, and FIG. 2*b* is a view for showing the state of preparing for a use of a nail clipper of the invention, FIG. 3*a* is an exploded perspective view of a nail clipper 100 according to an embodiment of the invention, FIG. 3*b* is a view of a state unfolding a bent center part for showing a rigid section and an elastic section of a nail cutter 20 of a nail clipper applied to the invention, and FIG. 3*c* is a view of a state unfolding a bent center part for showing the other modifications of the nail cutter 100 illustrated in FIG. 3*b*.

A nail clipper 100 of the invention may basically comprise a nail clipper body 10, a nail cutter 20 (hereinafter, "cutter"), a supporting shaft 30, and a lever 40. Further, the nail clipper 100 may selectively comprise a nail-handling tool 50.

The nail clipper body 10 may be made of plastic or metal. In case of manufacturing using plastic, for example, a light and clear image of the product will be expected by injection molding with a transparent material.

The nail clipper body 10 is formed with a substantially horizontal surface on an upper part thereof. Further, the body 10 has a suitable size to grip, and is formed with a supporting hole 11 at one end thereof. A bottom surface of the supporting hole 11 is formed with a nail cutter rotating site 12 forming the cutter receiving part by being completely opened downwardly to allow a direct access of a finger from a lower part. The nail cutter rotating site 12 is formed with a plurality of click grooves 13 radially on a circumference thereof centering around the supporting shaft hole 11. Further, a bottom surface of the nail clipper body 10 is formed with a gripping part 18 having an arch shape for rendering a finger to stably grip. The arch shaped gripping part 18 accomplishes an additional function of being esthetically pleasing.

The nail cutter rotating site 12 comprises areas opened in the lateral and lower directions, and becomes a place for receiving the cutter 20. Thus, the nail cutter rotating site 12, in case of manipulating to rotate the cutter 20 with a finger to manipulate an angle of the cutter 20, is provided to allow a free access of the finger, and to manipulate a rotating motion of the cutter 20 with the finger by any angle within a range of 360° without interference of an obstacle.

The click grooves 13 are formed for setting a rotation angle of the cutter 20. According to one embodiment of the invention, the click grooves 13 are directed considering the rotation use angle of the cutter 20 from the longitudinal direction of the body to any one angle of 0°, ±40°, and ±80° for example. Thus, number of the click groove 13 may be increased or reduced considering a use angle of the cutter 20.

Further, the click grooves 13 serve to prevent the cutter 20 from rotating together with the lever 40, when the lever 40 is rotated with lifted up as shown in FIG. 2*a* to use the lever 40 laid on the nail clipper body 10.

Here, the click grooves 13 are formed on a projection site 14 slightly projected from the nail cutter-rotating site 12 by a stepped jaw. The projection site 14 is a part for transferring a pressing force of the lever 40 to the cutter 20.

The nail cutter 20, which is made of metal, includes an upper cutter 25 and a lower cutter 26 having a rigid section S having oppositely disposed cutting blades 21, 22 formed at one end thereof and a supporting shaft hole 23, and an elastic section L bent at the other end. The elastic section L includes a breakage preventing and elastic flexible means for preventing a breakage of the cutter due to a repeatedly pressing stress, and simultaneously for securing a flexible elastic property.

Specifically, referring FIGS. 3*b* and 3*c*, the elastic section L forms an elongated hole 24*a* having a constant width Wc in the longitudinal direction form a bent center part 24. A uniformly remained widths $W_1$, $W_2$ and a predetermined distances $L_1$, $L_2$ form an area within which a repeatedly pressing stress is uniformly and widely dispersed. Thus, stress concentration is prevented, whereby the bent center part 24 is prevented from breaking.

Further, referring to FIGS. 5*a* to 5*c*, and 8*a* to 8*c*, the elastic section L has a narrower width w than the width W of the cutter over a predetermined distance L, whereby a breakage prevention of the bent center part 24 and a flexible elasticity within the elastic section L may be provided.

Figure 6:
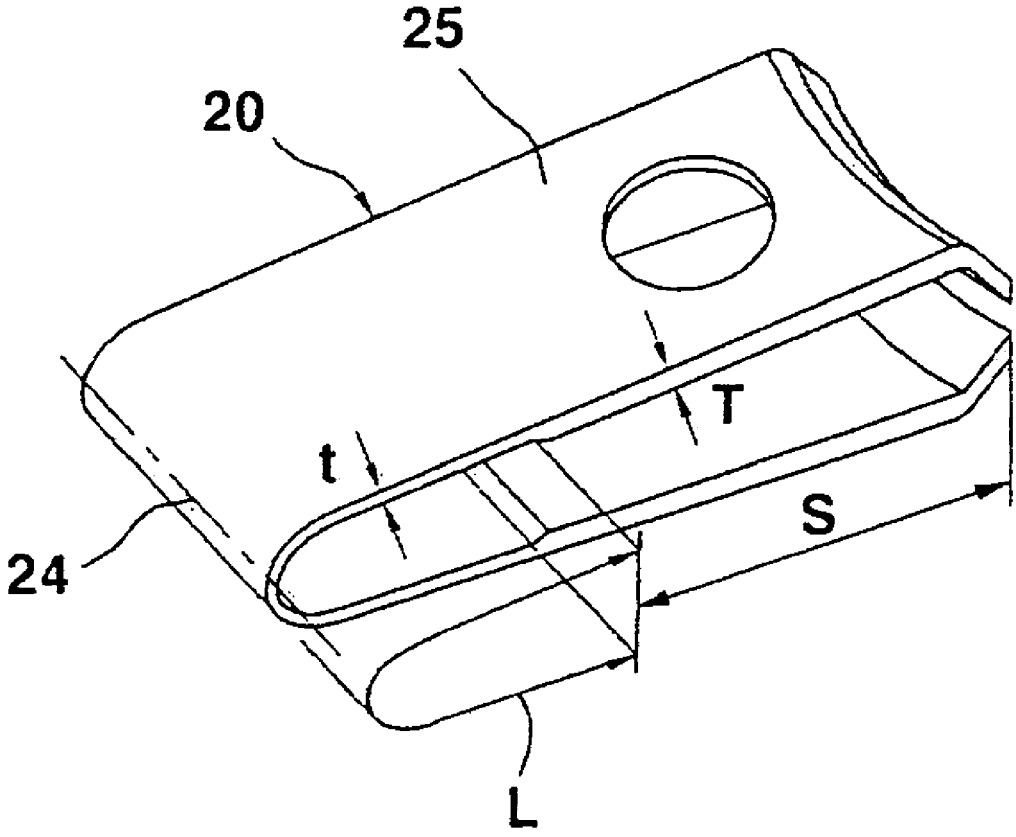
Figure 9:
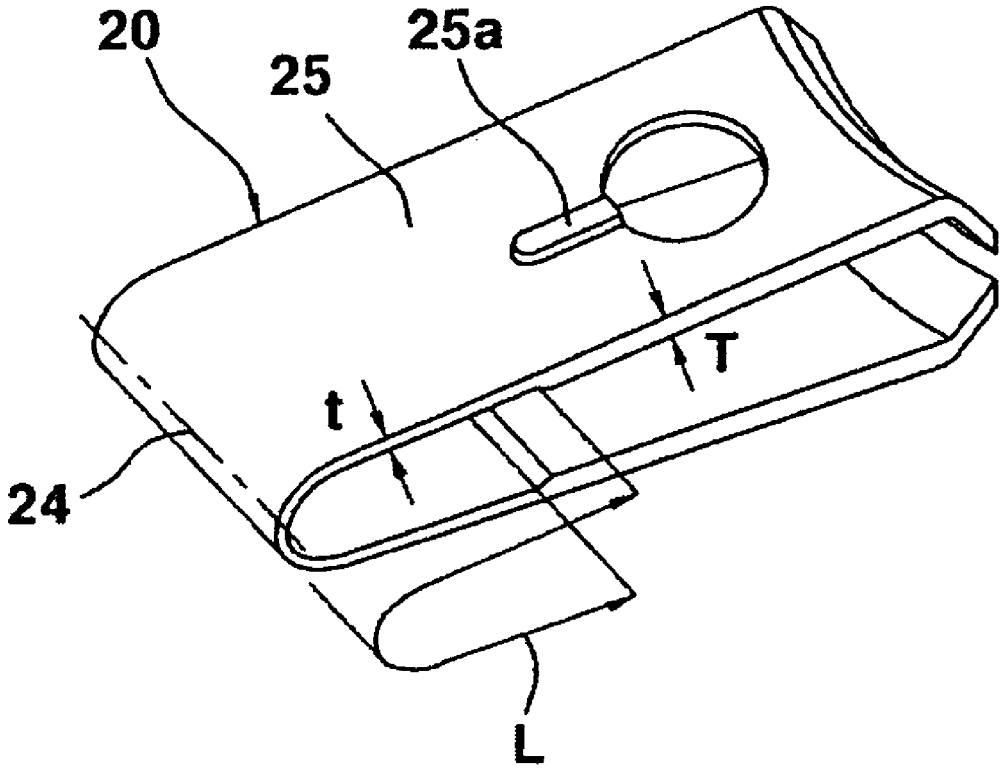

Further, referring to FIGS. 6 and 9, the elastic section L of the cutter 20 may have a relatively thinner thickness t than the thickness T of the rigid section over an extended length.

Meanwhile, the elongated hole 24*a* is formed with a connection supporter 24*b* for preventing a twist, which transverses in the cross direction, thereby preventing the upper and lower cutters 25, 26 from twisting. Further, as shown in FIG. 3*c*, one elongated hole may be formed without the connection supporter.

Figure 4A:
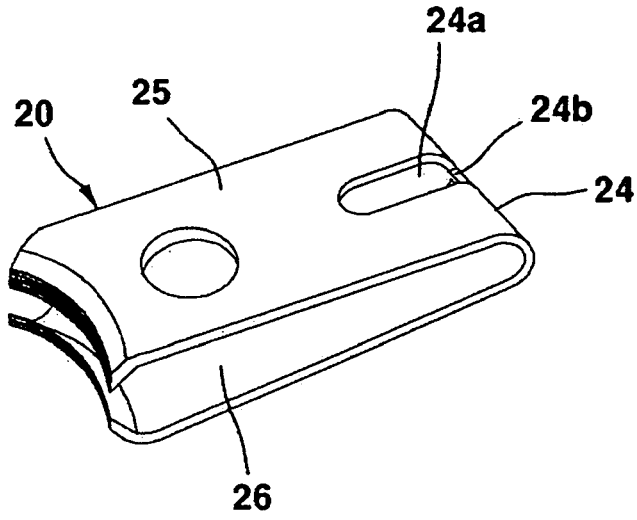
FIGS. 4*a* to 9 are views for illustrating various modifications of a nail cutter of a nail clipper applied to the invention.
Figure 4B:
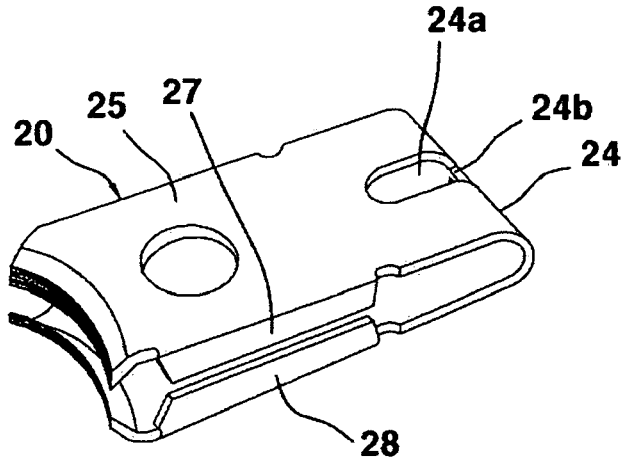
Figure 4C:
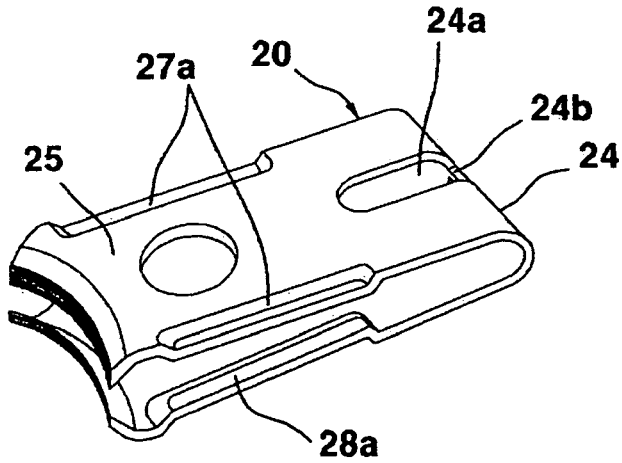
Figure 5A:
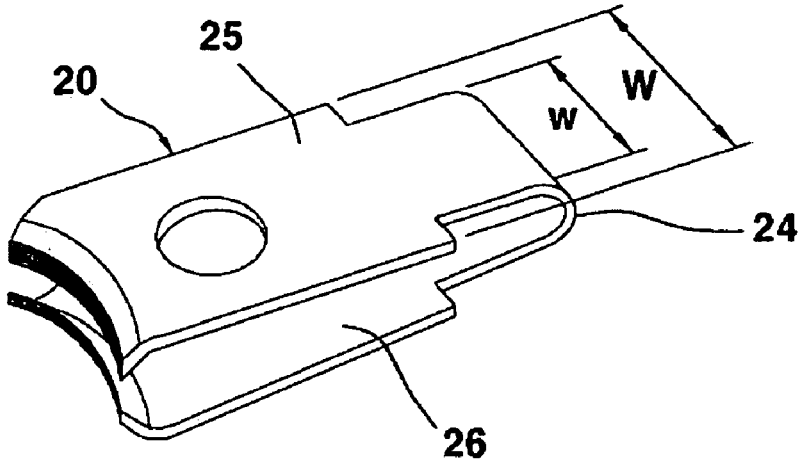
Figure 5B:
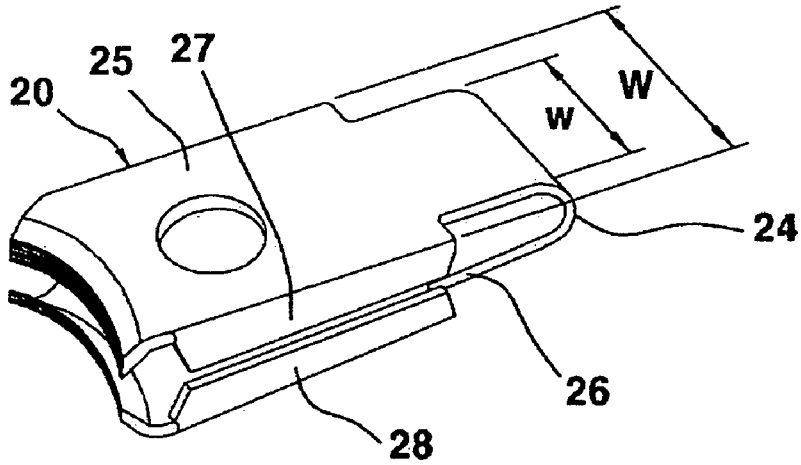
Figure 5C:
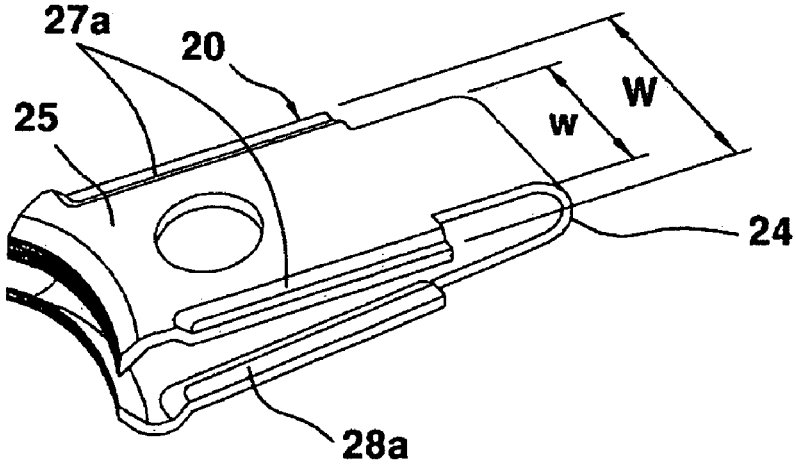

FIGS. 4*a* and 5*a* are illustrative views of cutter 20 for providing flexible elastic means using a thick material rendering the rigidity to be maintained. Referring to FIGS. 4*b* and 5*b*, the upper cutter 25 and the lower cutter 26 further may include reinforcing ribs 27, 28, having a predetermined length, extended and bent at a right angle on both side ends of the rigid section S thereof in order to reinforce the rigid section for preventing bending of the rigid section. Referring to FIGS. 4*c* and 5*c*, the upper cutter 25 and the lower cutter 26 may further include reinforcing ribs 27*a*, 28*a* transformed by pressing edges of both side ends thereof.

Here, the reinforcing ribs 27, 28 or 27*a*, 28*a* serve to prevent bending of the cutter 20 in case of using a steel member or a stainless steel member having a thickness of 1.2 mm or less.

Further, the reinforcing ribs 27, 28 also serve to prevent a cut nail from scattering in the lateral direction, since the ribs are accessed near with faced each other when the cutters 20 makes a biting motion.

Figure 7A:
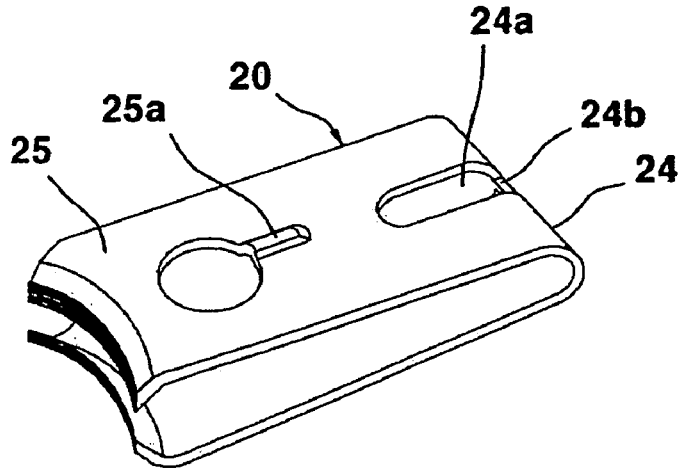
Figure 7B:
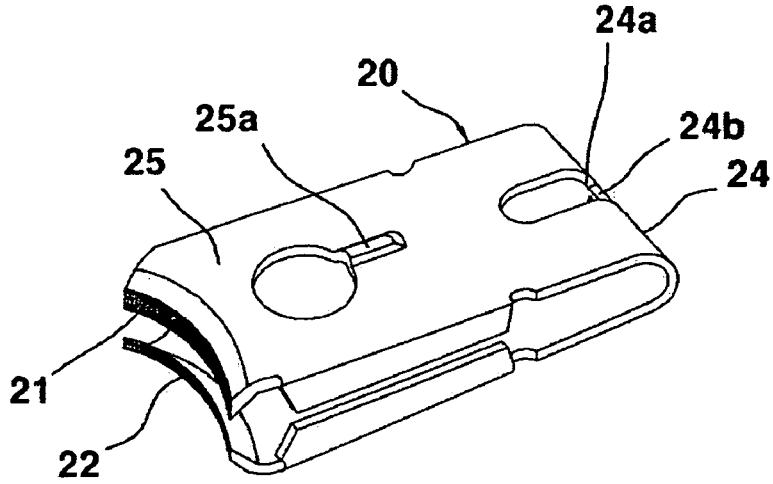
Figure 7C:
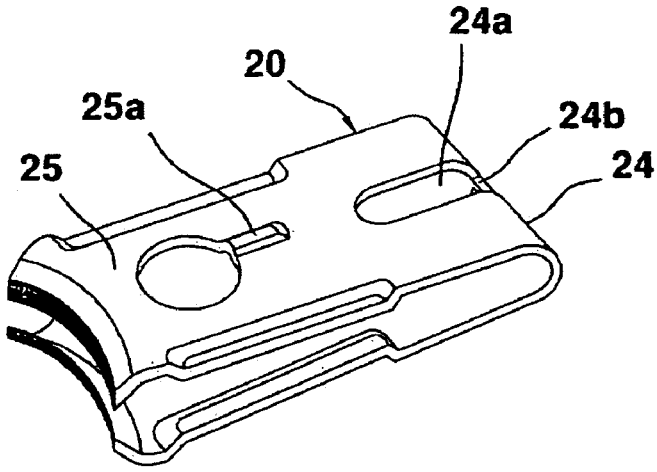
Figure 8A:
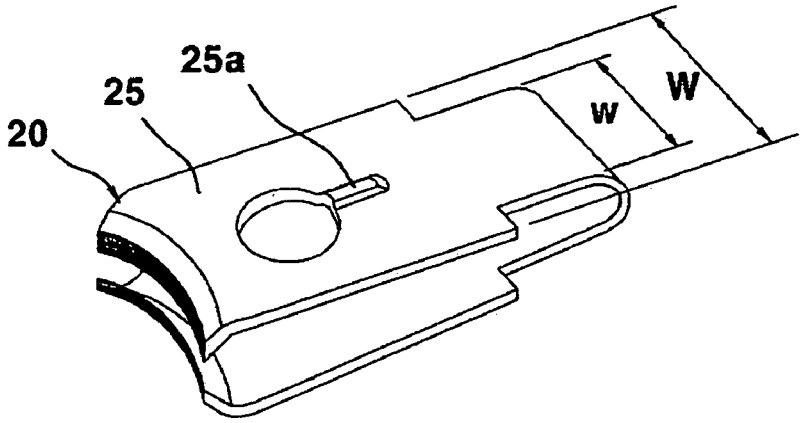
Figure 8B:
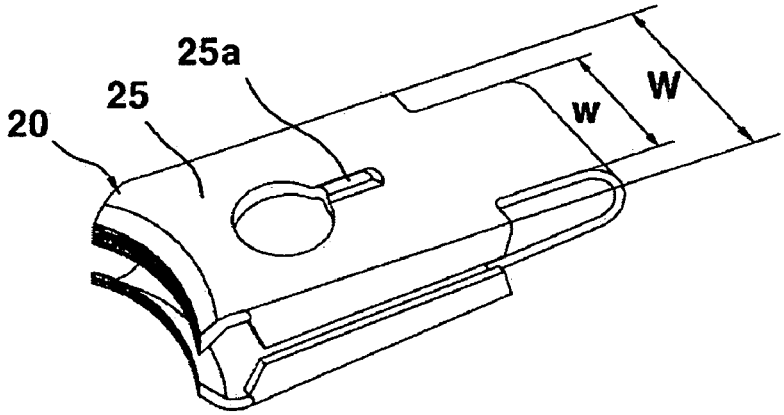
Figure 8C:
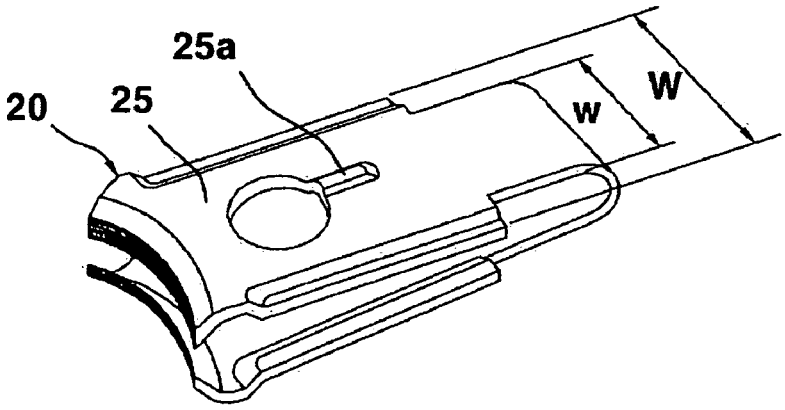

FIGS. 7*a* and 9 show another modification of the cutter 20. Referring to FIGS. 7*a* and 9, one click projection 25*a* projected adjacent to the supporting shaft hole 23 on the upper surface of the upper cutter 25 is formed on the cutters 20. The click projection 25*a* is hooked and engaged into the click groove 13 of the body 10. The cutter 20 according to the invention may a plurality of click projections 25*a*, although the embodiment of the invention has only one click projection 25*a*.

Figure 11:
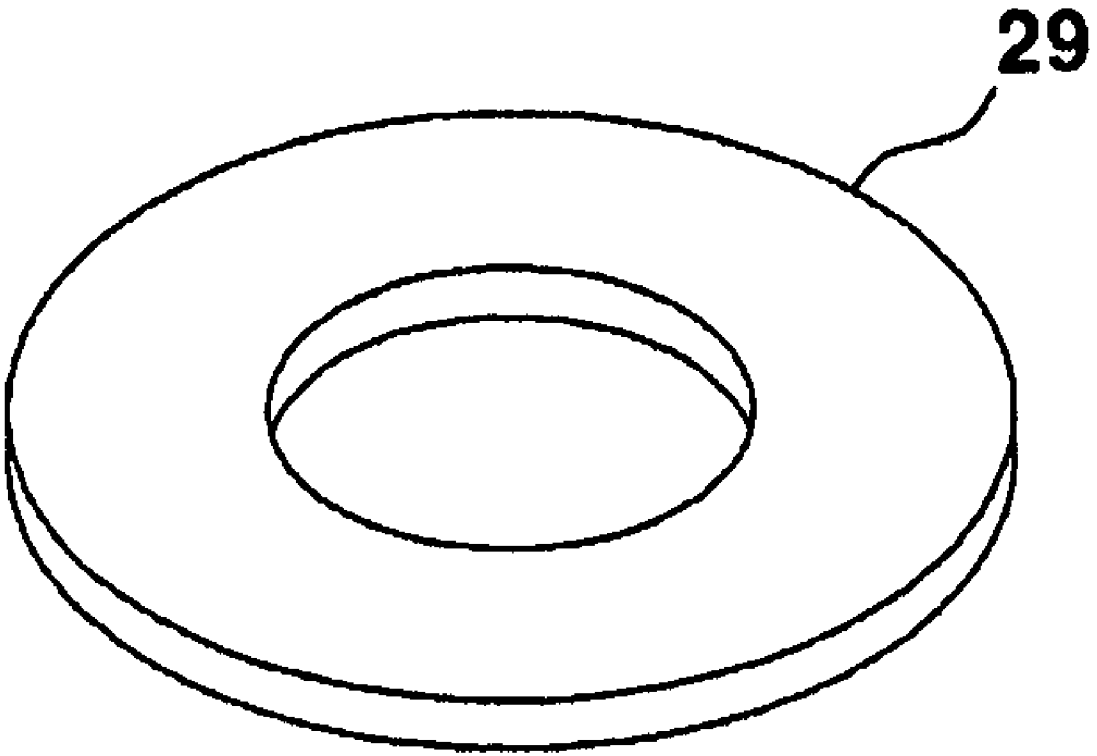
FIG. 11 is a perspective view of a washer applied to the invention.

In case that the cutter 20 has no the click projection 25*a* as shown in FIGS. 4*a* to 6, a washer 29 made of rubber, silicon, or the like as shown in FIG. 11 may be used.

Figure 10A:
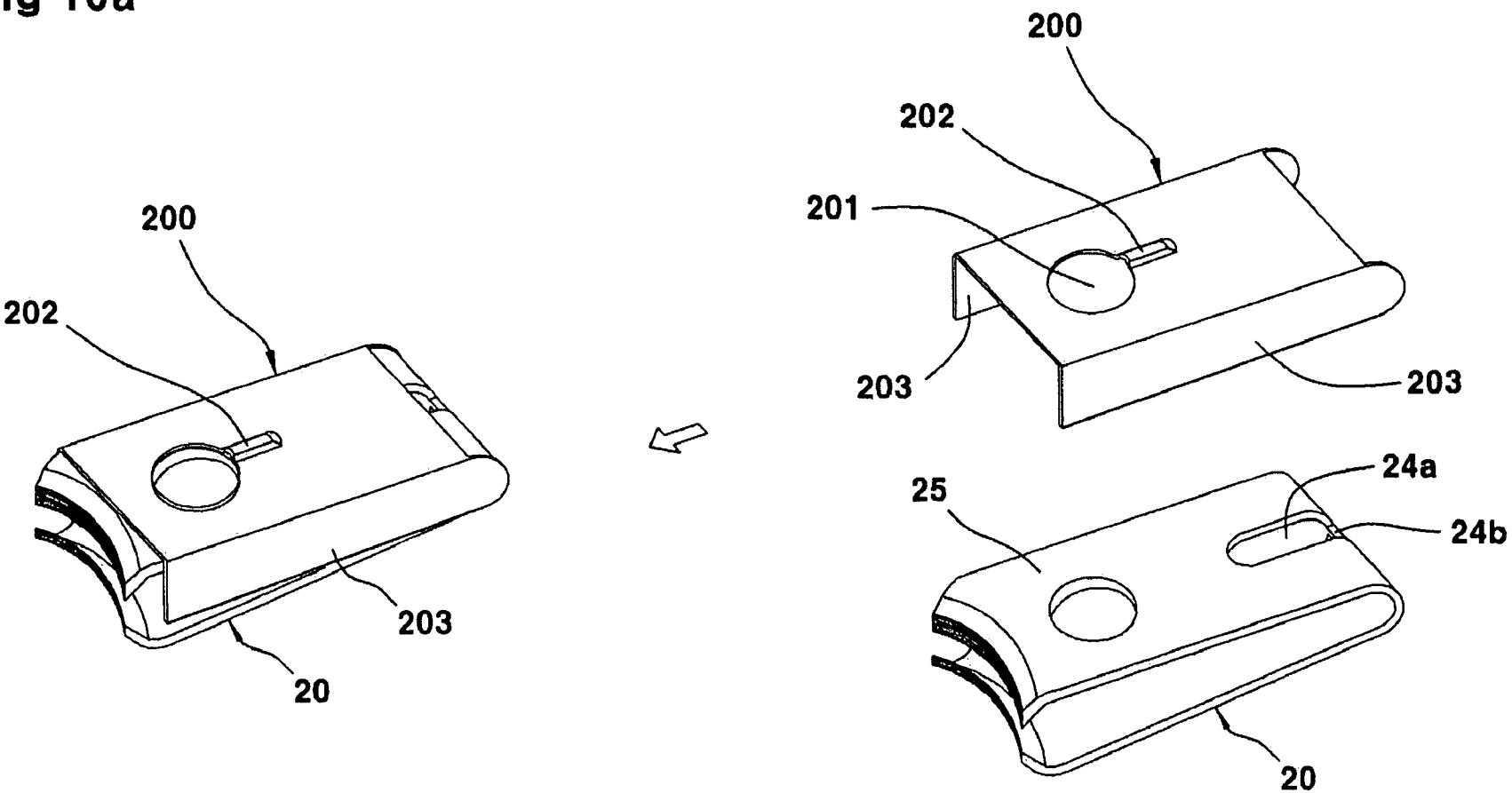
FIG. 10*a* is an exploded perspective view according to before assembly of an upper cutter cover applied to the invention and a perspective view according to after assembly of the same.

Further, the cutter 20 may have an upper cutter cover 200 made of metal plate as shown FIG. 10*a*. FIG. 10*a* is an exploded perspective view of the upper cutter cover 200 and the cutter 20, and a view of assembled state of the upper cutter cover 200 and the cutter 20.

The upper cutter cover 200 includes a supporting shaft hole 201 positioned in the same axis as the supporting shaft hole 11 of the body 10, at least one click projection 202 formed adjacent to the supporting shaft hole 201, and plates 203 for preventing nails from scattering, which are formed by bending both side parts of the cover 200.

Figure 10B:
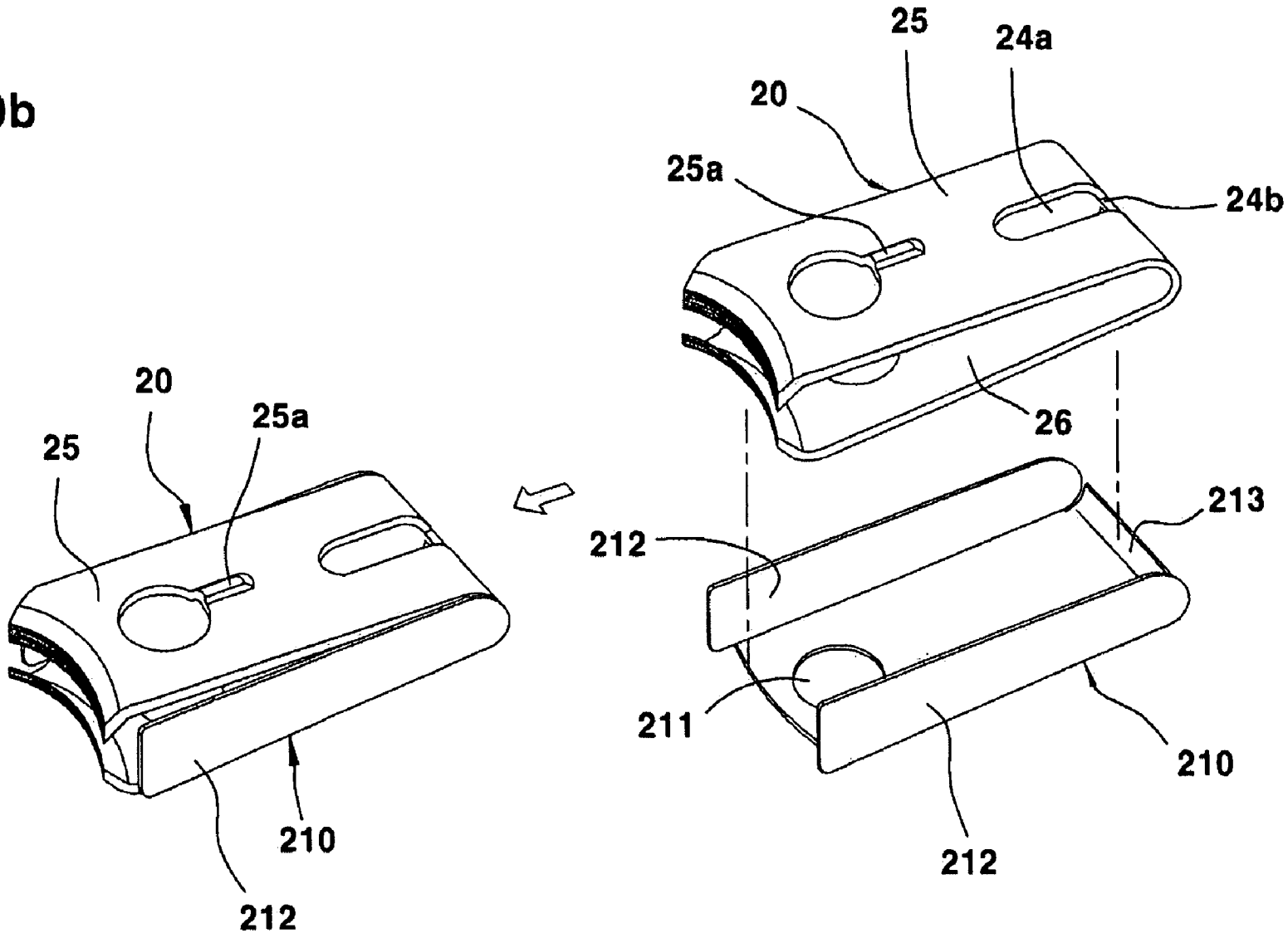
FIG. 10*b* is a separated perspective view according to before assembly of a lower cutter cover applied to the invention and a perspective view according to after assembly of the same.

FIG. 10*b* shows an assembling state of a lower cutter cover 210 and the cutter 20. Referring to FIG. 10*b*, the lower cutter 26 is covered with the lower cutter cover 210 including a supporting shaft hole 211, plates 212 for preventing nails from scattering in the lateral direction, and a plate 213 for preventing nails from scattering in the rear direction.

Figure 15:
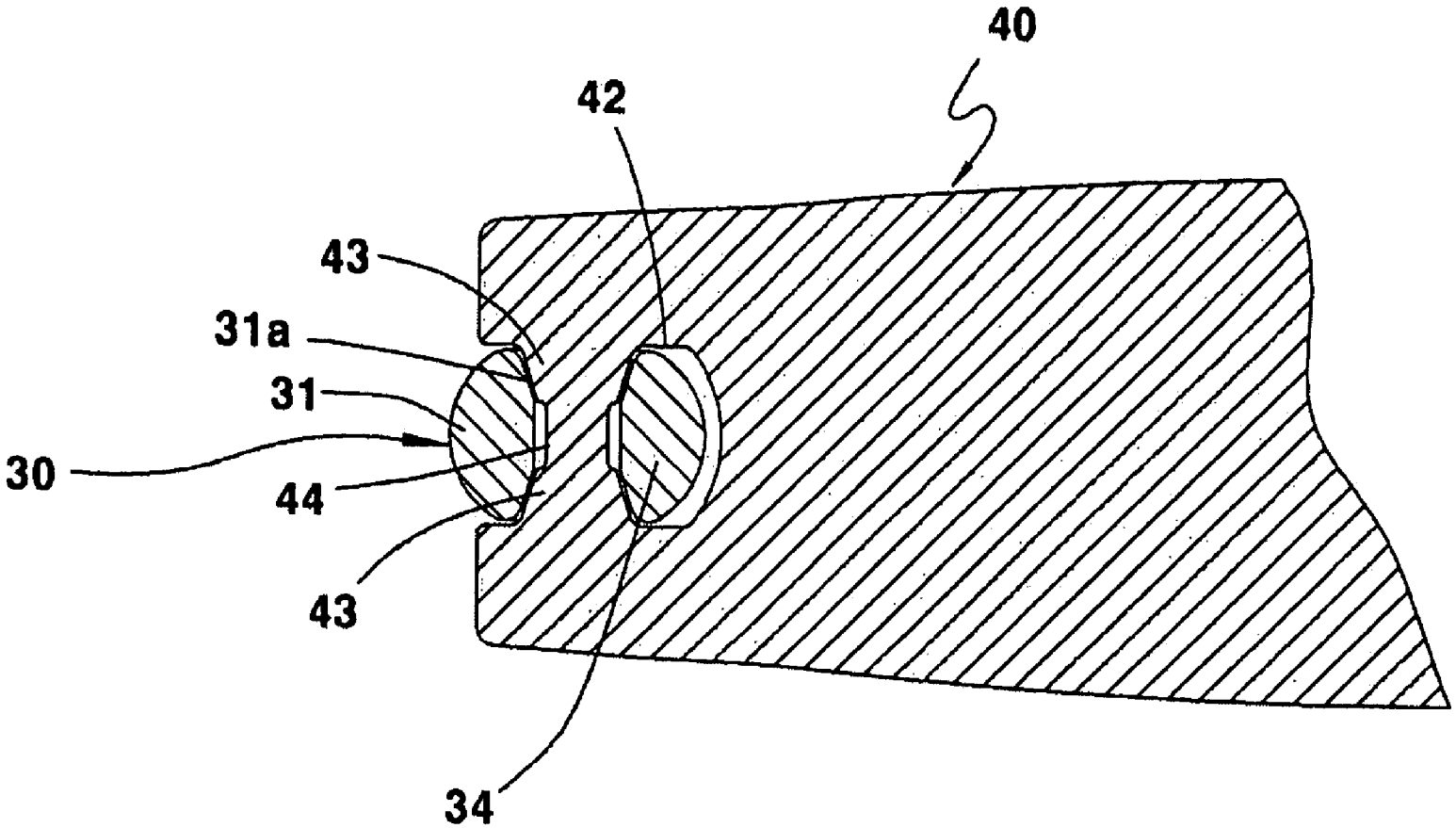
FIG. 15 is a cross-sectional view of a coupled state of a supporting shaft and a lever taken on line A—A of FIG. 1.

The lever 40 may be made of plastic or metal. Referring to FIGS. 3*a* and 15, one end of the lever 40 is connected to one end of the supporting shaft 30. A lever fulcrum 41 adjacent to the one end of the lever 40 is contacted to the upper surface of the body 10 for leverage. A pressing part 46 extended from the lever fulcrum 41 renders widened cutting blades 21, 22 of the cutter 10 to bite a nail by pressing with a finger to generate a cutting force.

Further, a concave part 42 is formed in the part connected with the supporting shaft 30. The opposite faces formed by the concave part 42 are formed with a pair of projection shafts 43, which have a trapezoidal cylinder shape, disposed oppositely. The projection shafts 43 are connected by a supporting shaft 44, which has a stepped height about the projection shaft 43, for preventing the concave part 42 from widening in the width direction.

Here, the supporting shaft 44 connects both ends of the projection shaft 43, and has a smaller area than the cross area of the end of the projection shaft 43.

Referring to FIGS. 2*a* and 3*a*, the supporting shaft 30 connects and supports the lever 40 and the cutter 20 by being co-axially inserted into the supporting holes 11, 23 of the body 10 and the cutter 20. Thus, the supporting shaft 30 serves to transfer leverage force of the lever to the cutter 20.

The supporting shaft 30 comprises a head part 31, which has a spherical shape, having a hole 31*a* in one end thereof for coupling with the supporting shaft 44 of the lever, divided surfaces 32 formed by being divided and longitudinally extended from a center of the head part 31 for allowing fitting of the supporting shaft 43, a pair of wedge hooking projections 33 oppositely formed on internal surfaces of the divided surfaces 32, a hooking jaw 34 formed at an end of the divided surfaces 32 for hooking to a bottom surface of the supporting shaft hole 23 of the cutter 20, and a wedge 35 having a hooking hole 35*a* for engaging with the wedge hooking projection 33 by being fitted between the divided surfaces 32.

Here, the wedge 35 has a shorter length than that of the divided surface 32 not to hinder the projection shaft 43 from positioning in the head part 31 of the supporting shaft 30.

A method for assembling the supporting shaft 30 to the body 10, cutter 20 and the lever 40 will be given herein below.

To begin with, the supporting shaft 30 is fitted to the projection shaft 43 of the lever 40. At this time, the projection shaft 43 of the lever 40 is inserted between the divided surfaces 32 of the supporting shaft 30, and then positioned within the head part 31.

Then, the supporting shaft 30 engaged with the lever 40 is inserted into the supporting shaft hole 11 of the body 10 and the supporting shaft hole 23 of the cutter 20. At this time, the cutter 20 is assembled with the click projection 25*a* of the upper cutter 25 positioned in the click groove 13 of the projecting site 14 of the body 10. By doing so, the hooking jaw 34 of the end of the supporting shaft 30 is exposed from the bottom surface of the lower cutter 26. Then, the wedge 35 is inserted between the divided surfaces 32 of the supporting shaft 30, whereby the assembly is finished. At this time, the hooking projection 33 is engaged into the hooking hole 35*a* of the wedge 35, and the hooking jaw 34 of the supporting shaft 30 is widened, whereby the supporting shaft 30 is not separated by being hooked from the bottom surface of the lower cutter 26 in cutter 20.

Therefore, the supporting shaft 30 has a structure for the divided surfaces 32, the projection shaft 43 of the lever 40 is engaged with the divided surface 32, and the supporting shaft 30 is not separated due to an engagement of the wedge 35, whereby the assembly process is very simple, and a concrete structure after assembling is maintained.

Meanwhile, the nail clipper 100 of the invention may further comprise a nail handling tool 50.

FIG. 3*a* shows an example of the nail handling tool 50. The nail handling tool 50 is constituted to be detachably engaged to the receiving part 18 via a slot 19 formed in a rear end of the body 10.

The nail handling tool 50 comprises a file plate settling part 51 formed at one end thereof, a push button part 52 extended form the file plate settling part 51, and having a hooking jaw 52*a* for hooking into a hooking hole 19*a* of the receiving part 19, a tool body 54 extended from the file plate settling part 51, and simultaneously including a surrounding handle 53 having an about U letter shaped elongated hole 56 from a beginning end of the pushing button part 52, and a file plate 55 mounted on the file plate settling part 51. A hole 53*a* for a lanyard or the like may be formed in the handle 53.

Figure 12A:
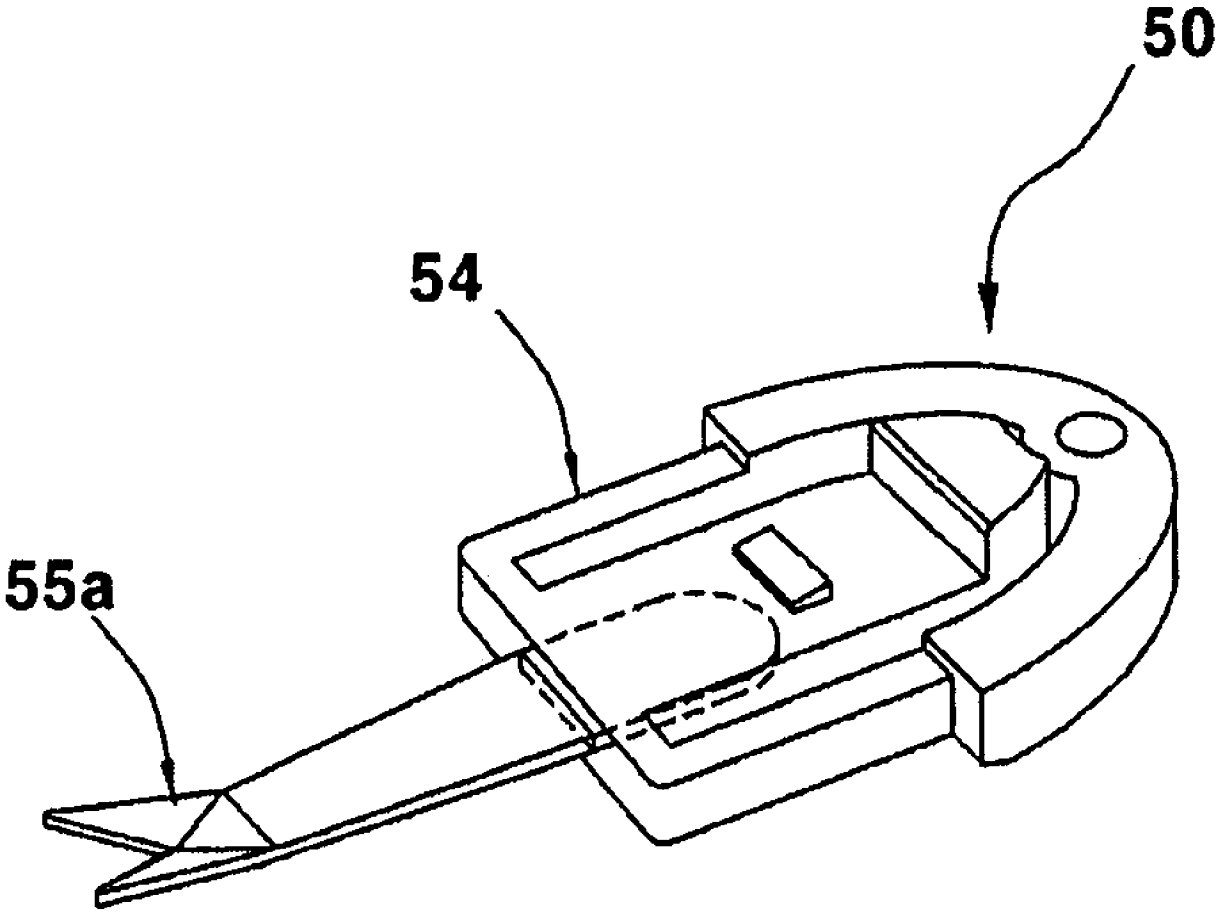
FIGS. 12*a* and 12*b* are perspective views for showing various shapes of nail handling tool applied to the invention.
Figure 12B:
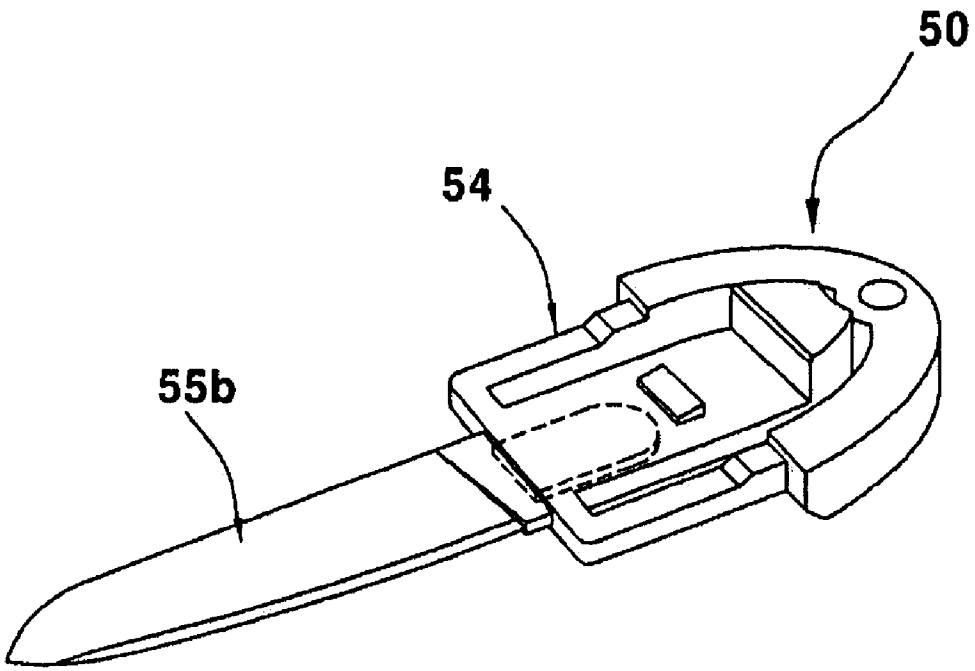

FIGS. 12*a* and 12*b* show various modifications of the nail handling tool 50, which have a pushing cutter 55*a* or a small-sized knife 55*b*.

In the nail handling tool 50, the reason why the push button part 52 and the handle are separated each other by the elongated hole 56 is that, in case of pushing the push button part 52 with gripping the handle 53, the push button part 52 is elastically bent, and the hooking jaw 52*a* is easily separated from the hooking hole 19*a* of the receiving part 19*a* of the body.

Figure 13A:
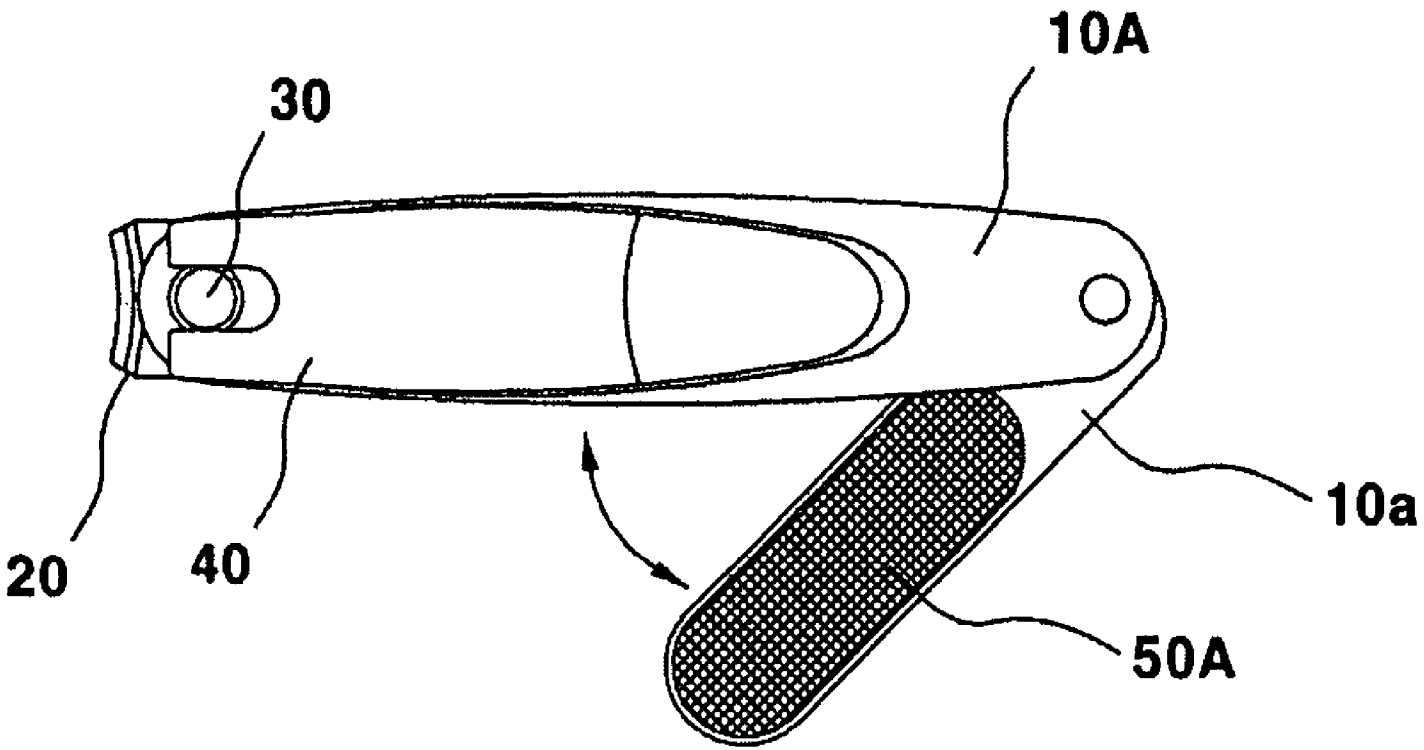
FIGS. 13*a* and 13*b* are various constitutional views of nail handling tool applied to the invention.

FIG. 13*a* shows another embodiment of the nail handling tool applied to the invention. Referring to FIG. 13*a*, a general nail handling tool 50A is mounted in the cover 10*a* and then may be hinged to a rear end of the nail clipper body 10A by way of opening and closing by horizontal rotation. Here, the general nail handling tool 50A may be selected from any one of a small-sized knife, a small-sized scissors, and a file.

Figure 13B:
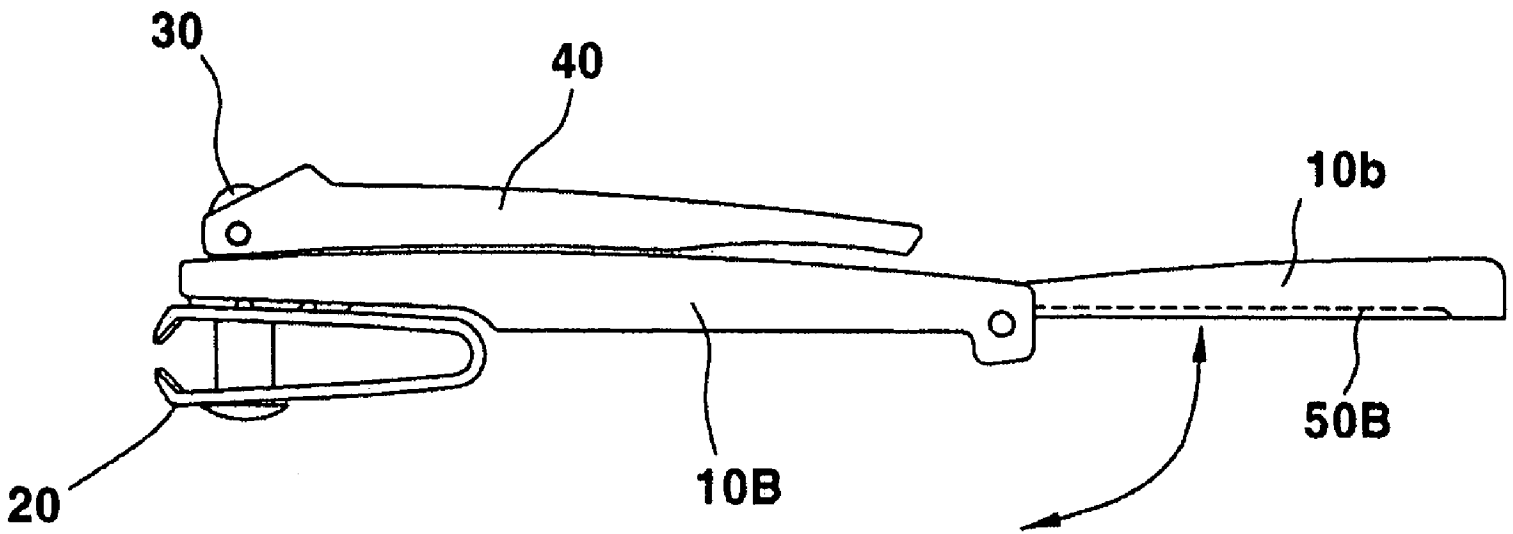
Figure 14:
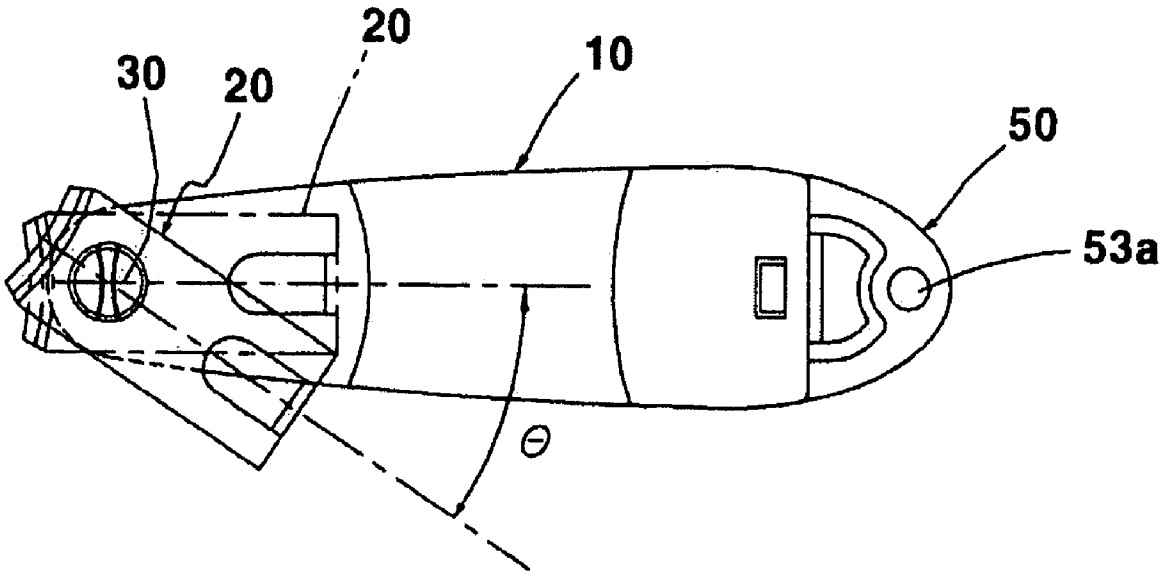
FIG. 14 is a view for showing the state for using a nail cutter of a nail clipper applied to the invention.

FIG. 13*b* shows another embodiment of the nail handling tool applied to the invention. Referring to FIG. 13*b*, a general nail handling tool 50B is mounted in the cover 10*b*, and then may be hinged to a rear end of the nail clipper body 10B by way of opening and closing by up and down rotation.

The nail clipper body 10A, 10B is provided with covers 10*a*, 10*b* having nail handling tools 50A, 50B at a lower part thereof, and the covers 10*a*, 10*b* is constituted as a part of the body by pushing them shut when they are not used.

An operation of the embodiment of the nail clipper 100 according to the invention will be given herein below.

To begin with, the nail clipper 100, as shown in FIG. 1, can be manipulated with the lever 40 and the cutter 20 in parallel folded on the body 10. At this time, the lever fulcrum 41 of the lever 40 is not directly contacted with the body 10.

Although, under the above state, a user may use the nail clipper 100 by first setting the cutter 20 at a desired angle, it is preferable to manipulate the rotation angle of the cutter 20 after lifting up the lever as shown in FIG. 2*a*. This is resulted from that a rotation angle of the cutter 20 is substantially changed more than ever during cutting a nail.

If a user lifts up and turns over the lever 40, and rotates it to an original position, the lever 40 is lifted up by a predetermined angle about the body 10 to make an about V letter type. At this time, the lever fulcrum 41 is contacted to an upper surface of the body 10 adjacent to the supporting shaft hole 11.

Here, the reason why, upon rotating the lever 40, the cutter 20 is not rotated by the rotated supporting shaft 30 is that the click projection 25*a* of the cutter 20 is elastically engaged to the click groove 13 of the body 10.

If, under the above state, the user is about to adjust an angle θ of the cutter 20 to a user's desired position, the user, as shown in FIG. 2*b*, grips the both sides of the cutter 20 by one hand with holding the lever 40 and the body 10 by the other hand, and then rotates the cutter 20 to set a desired angle. At this time, since the cutter 20 is opened in the lateral and lower directions, the cutter 20 is easily adjusted to a free angle by a finer without an interference of an obstacle.

At this time, the click projection 25*a* of the cutter 20 serves to set a rotation angle of the cutter 20 each time the click projection 25*a* arrives in the click groove 13 of the body 10.

After manipulating the cutter 20 to a desired angle, upon pressing the lever 40, the elastic section L of the upper and lower cutter 25, 26 is moved on the basis of the bent center part 24 by leverage of the supporting shaft 30 and the lever fulcrum 41, and then the cutting blades 21, 22 bites a nail to cut the nail.

At this time, the reinforcing ribs 27, 28 serve to transfer a force obtained from the leverage to the cutting blades 21, 22 without a loss. Further, at this time, when the trimmed nail is scattered in the lateral direction, the reinforcing ribs 27, 28 serve to prevent the nail from scattering outside.

Therefore, according to the invention, since the free rotation angle of the cutter 20 is possible to be adjusted, a user can cut off nails conveniently even with a small motion without an inconvenience that the user should rotate the wrist or move the whole hand along the nail. Especially, in case that the user should cut the oppositely disposed toenail about one hand with the one hand, it is more useful.

Further, since the nail handling tool 50 is received in the receiving part 18 of the body 10, when the user grips the nail clipper in one hand, whereby the user feels a smoothness, rather than the file plate 55, in convention designs.

Further, since the projection shaft 43 of the lever 40 is connected to the supporting shaft 44 which is not directly contacted to the supporting shaft 30, the concave part 42 is not widened, thereby it is not feared that the supporting shaft 30 is separated.

FIGS. 16*a* to 18 show another embodiment of the nail clipper of the invention.

A nail clipper body 110 comprises a base body 110A made of metal plate, and a gripping body 110B serving as a gripping part by engaging with the base body. The lever 40 and the cutter 20 are assembled to the base body 110A through the supporting shaft 30 to constitute the nail clipper 100A.

The nail handling tool 50 can be detachably mounted to the body 110, if necessary, through a receiving part 122 formed within the base body 110A coupled to the base gripping body 110B.

As described above, if the body 110 is divided into two pieces, the base body 110A and the gripping body 110B, and the cutter 20 is assembled through the base body 110A made of metal, the rotation site 12 can be thinner more than ever, and the manufacturing cost can be reduced, with comparison to the one piece of the nail clipper body 10.

One side of the base body 110A is formed with a cutter rotation site 112 at which the cutter 20 is rotatably positioned, the supporting shaft hole 111 is passed through the cutter rotation site 112, a click groove 113 together with a projection site 114 is formed around the supporting shaft hole 111, and the other side of the base body 110A is formed with a stepped jaw 115, a protuberance 116 and a hooking hole 117 for engaging with the gripping body 110B.

The gripping body 110B corresponding to the base body 110A is formed with a guide groove 120 for slidably inserting the base body 110A and a fixing stepped jaw 121 corresponding to the protuberance 116, a lower part of the guide groove 120 is formed with a receiving part 122 for receiving a nail handling tool 50 at a predetermined height, and a bottom surface of the gripping body 110B is formed with an arch-shaped gripping part 123.

According to the assembling process of the nail clipper body 110, if the base body 110A is slide along the guide groove 120 of the gripping body 110B, and pushed so that a stepped jaw 115 is contacted to one end of the gripping body 110B, the protuberance 116 is went over the fixing stepped jaw 121, and then hooked to the fixing stepped jaw 121, whereby the base body 110A is fixed to the gripping body 110B. Further, if the nail handling tool 50 is pushed into the receiving part 122, the hooking jaw 52*a* of the nail handling tool 50 is hooked into the hooking hole 117 of the base body 110A, whereby the nail handling tool 50 is detachably mounted to the base body 110A.

Figure 16A:
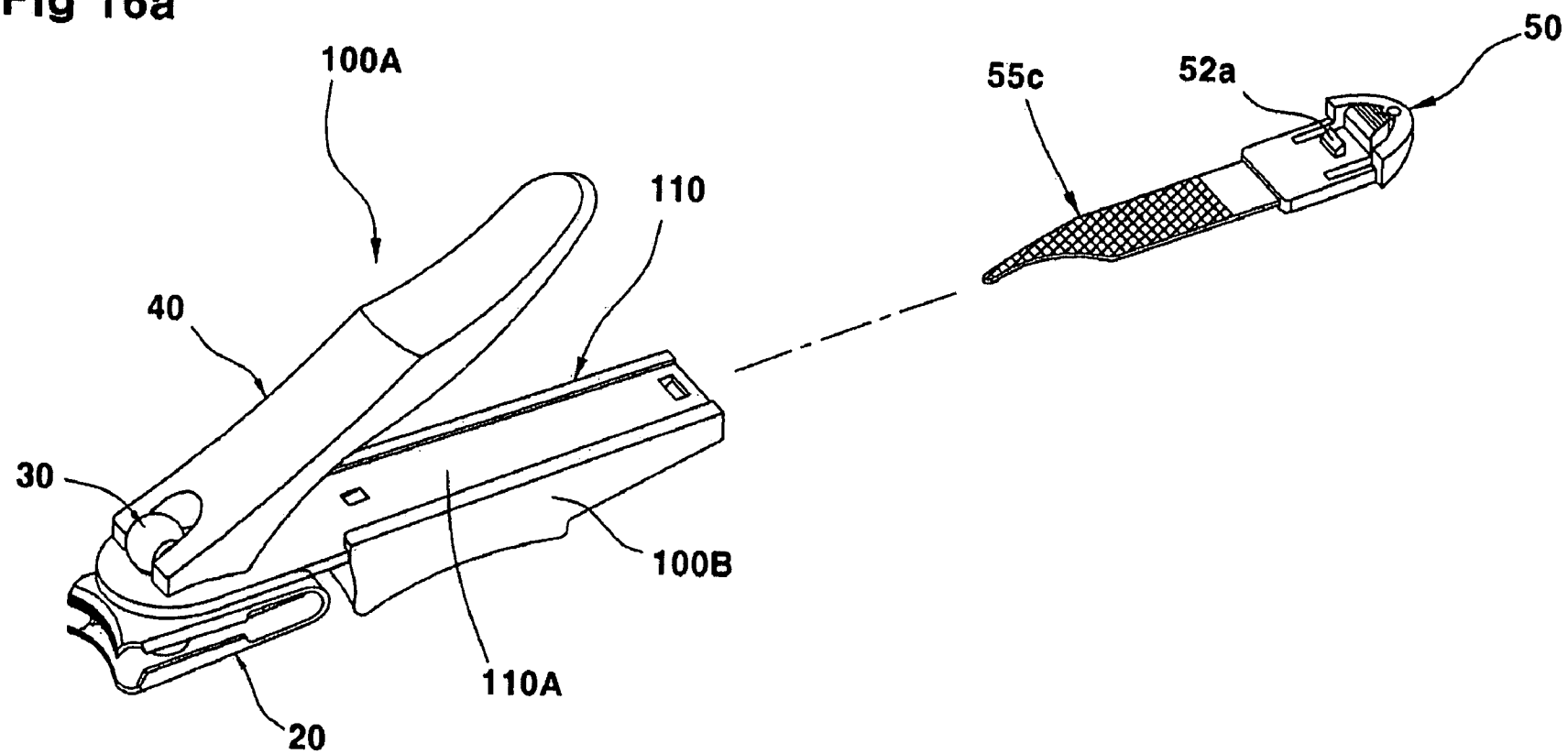
FIG. 16*a* is a perspective view of a nail clipper according to the other embodiment of the invention.
Figure 16B:
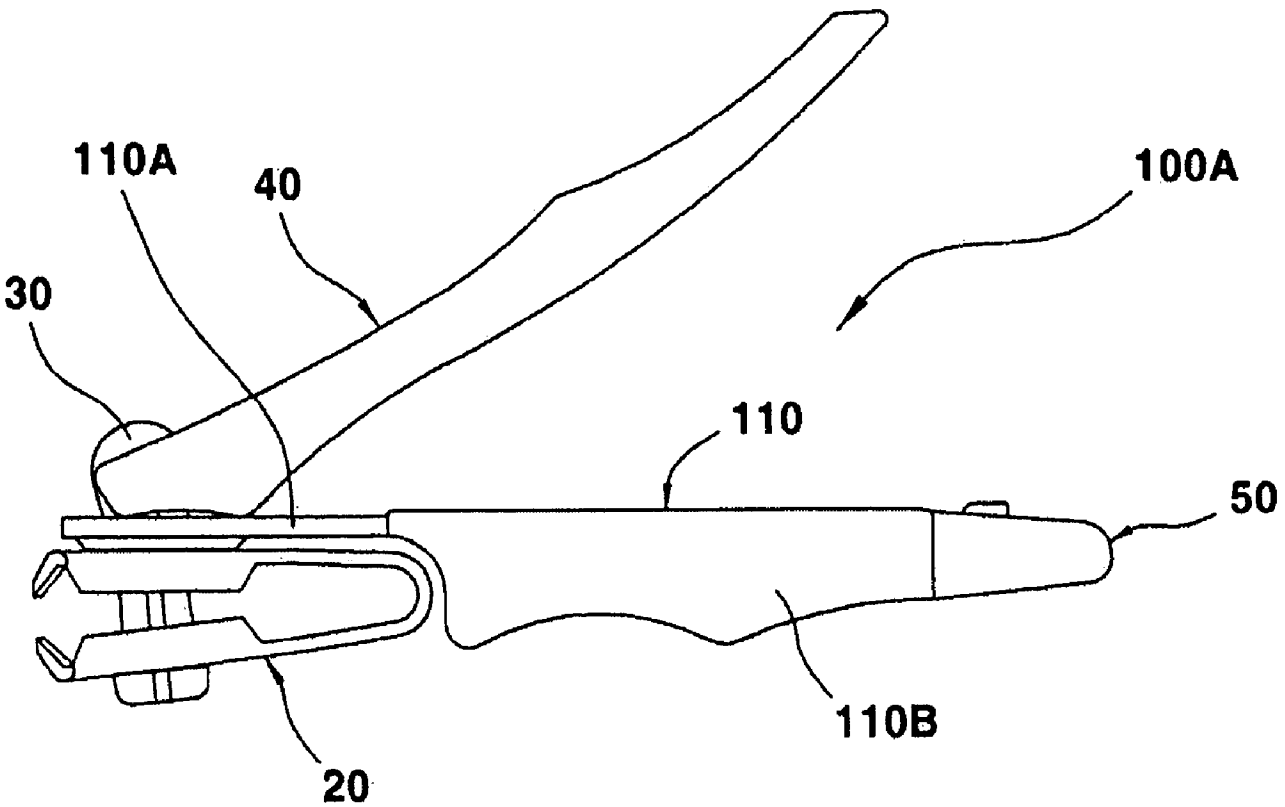
FIG. 16*b* is a front view of a nail clipper shown in FIG. 16*a;*
Figure 17:
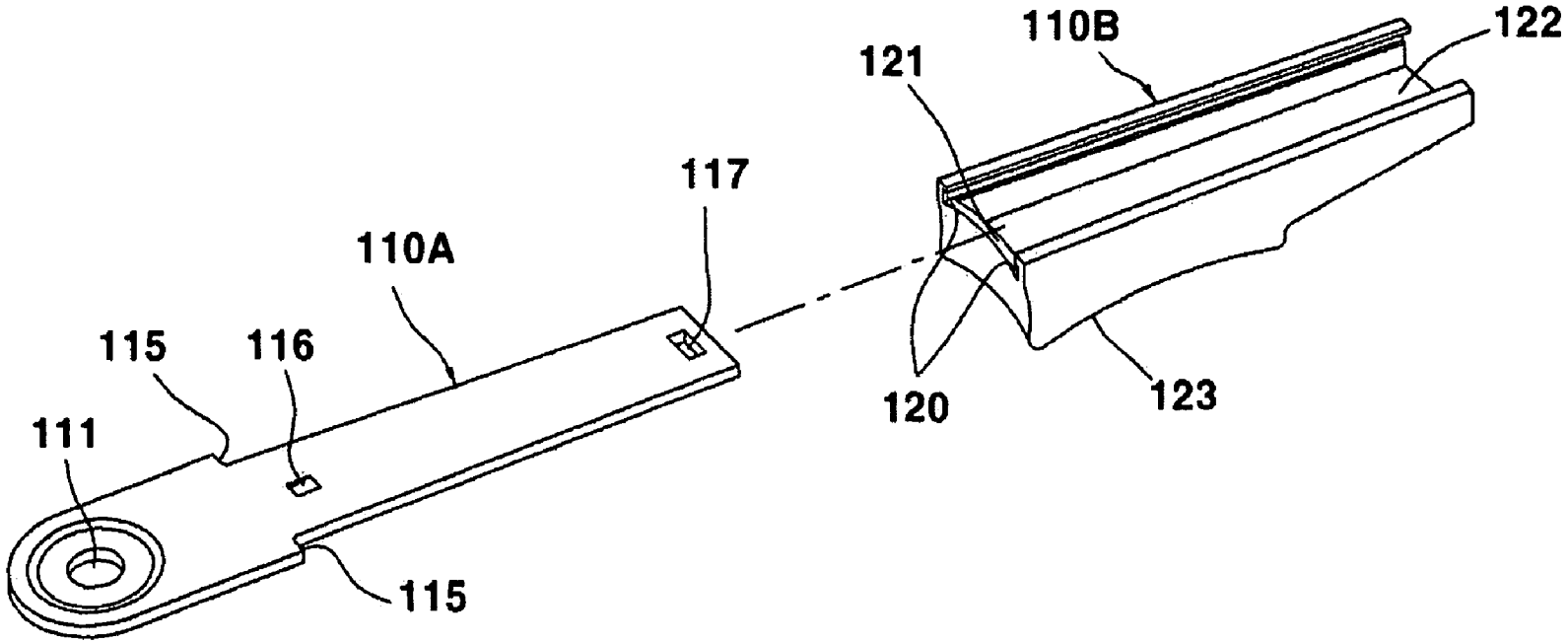
FIG. 17 is an exploded perspective view of modification of a nail clipper body of the invention.
Figure 18:
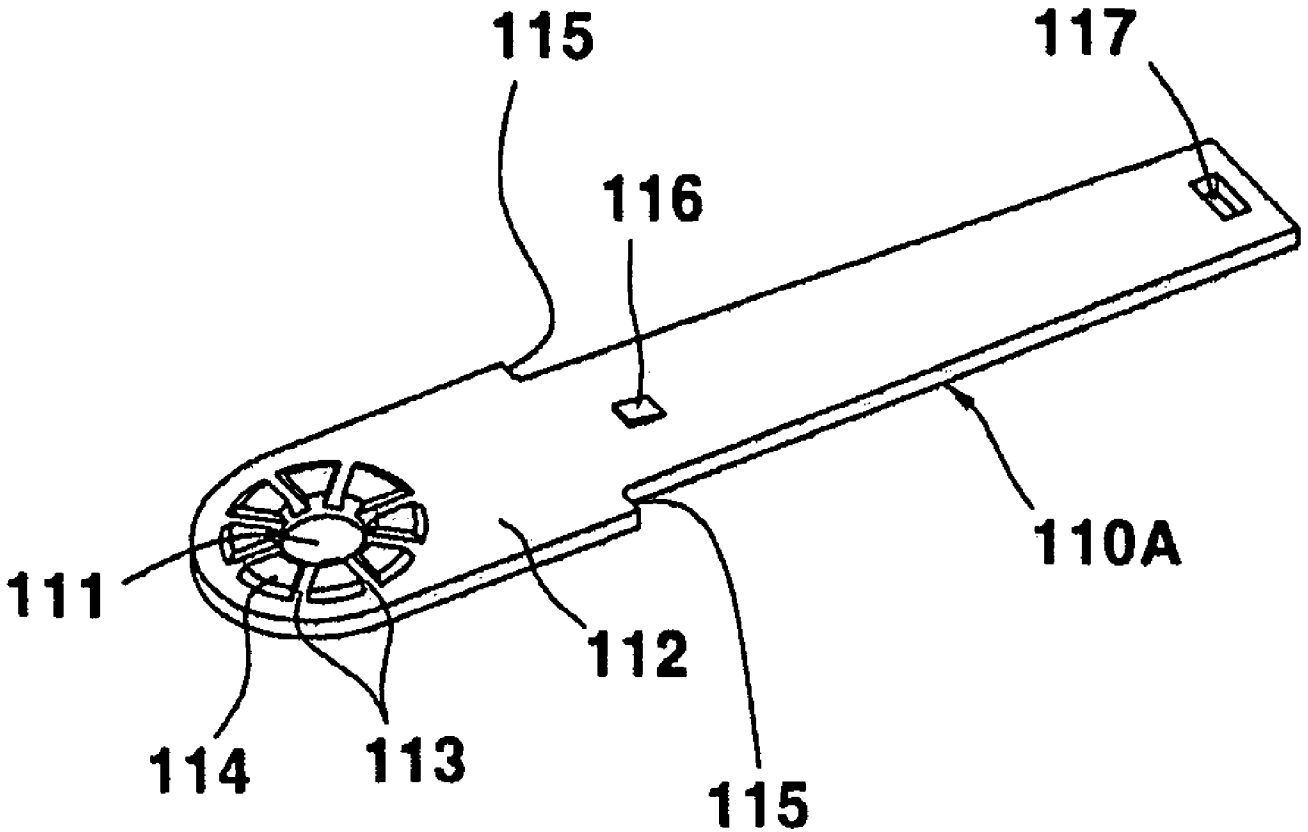
FIG. 18 is a perspective view for shown the state overturning the nail clipper body shown in FIG. 17.

The nail handling tool 50 shown in FIG. 16*a* illustrates an inserted nail file 55*c*.

Further, the washer 29 illustrated in FIG. 11 may be substituted for the projection site 114 and the click groove 113 formed around the supporting shaft hole 111 of the base body 110A to induce rotation and stop of the cutter 20.

Figure 19A:
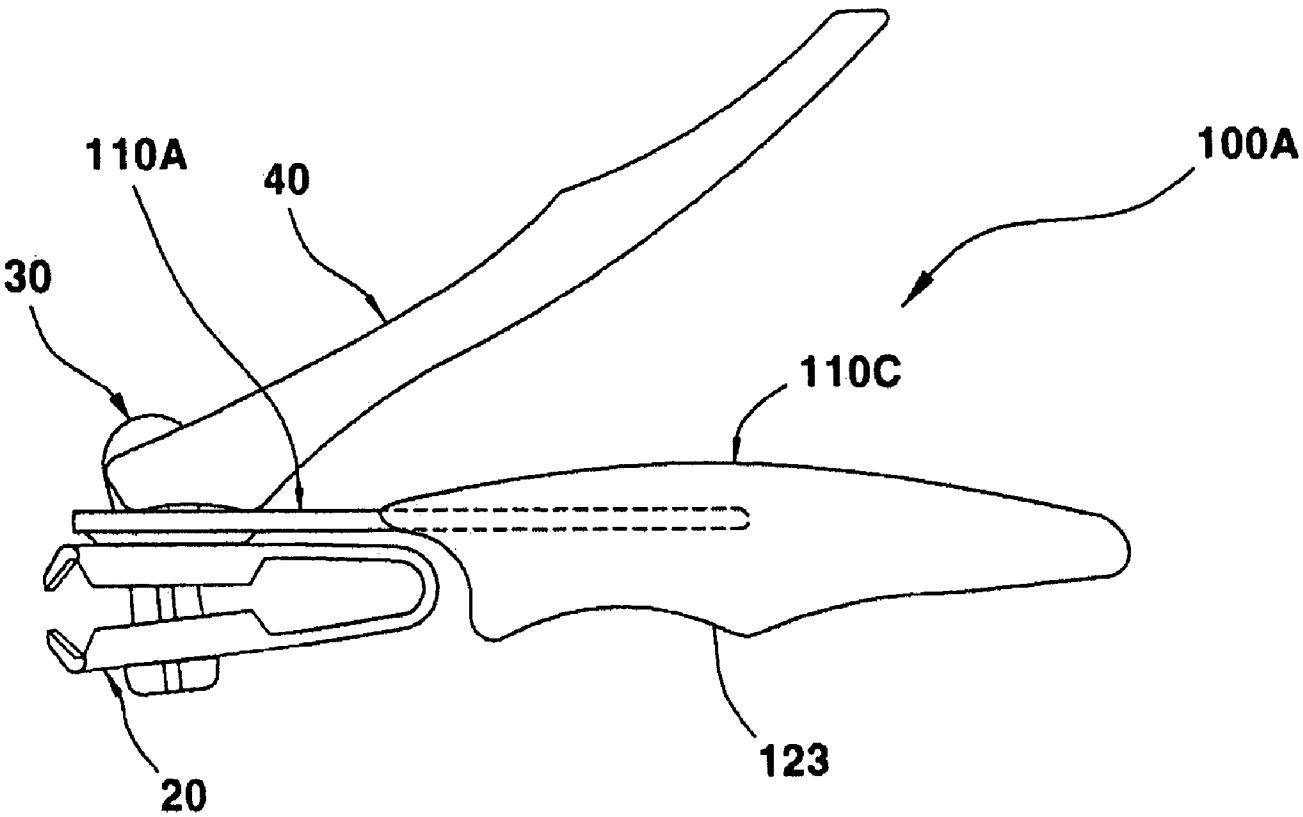
FIGS. 19*a* and 19*b* are front views for showing modifications of a nail clipper body of the invention.

FIG. 19*a* shows another modification of the nail clipper body. Referring to FIG. 19*a*, the base body 110A made of metal is inserted into a gripping body 110C.

Figure 19B:
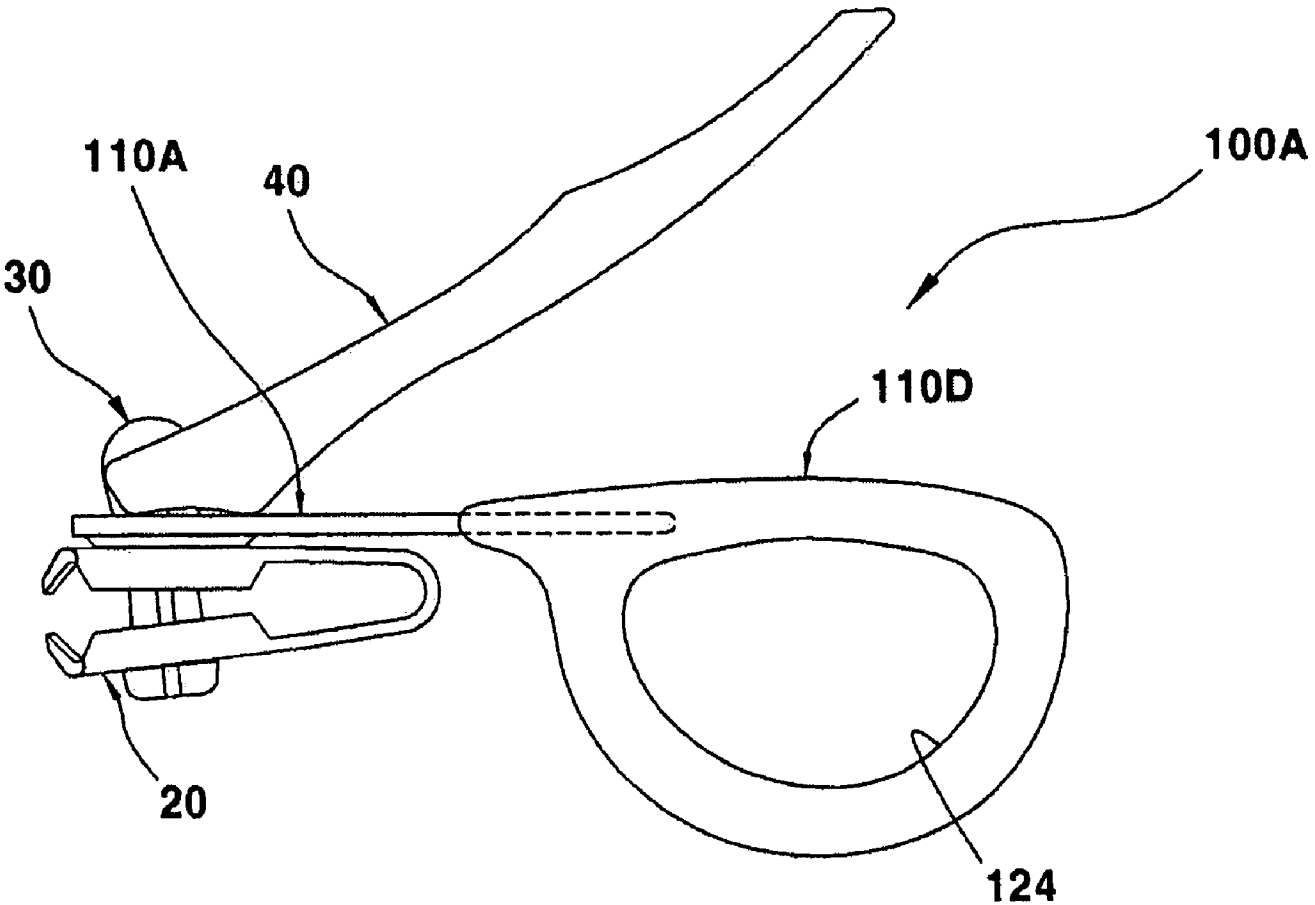

Referring to FIG. 19*b*, the base body 110A is inserted into a gripping body 110D, and the gripping body 110D has a finger gripping part 124 for gripping with a finger inserted.

According to the manufacturing method of inserting the base body 110A into the gripping body 110C, 110D, the manufacturing process is simple, whereby the manufacturing cost is reduced.

Figure 20A:
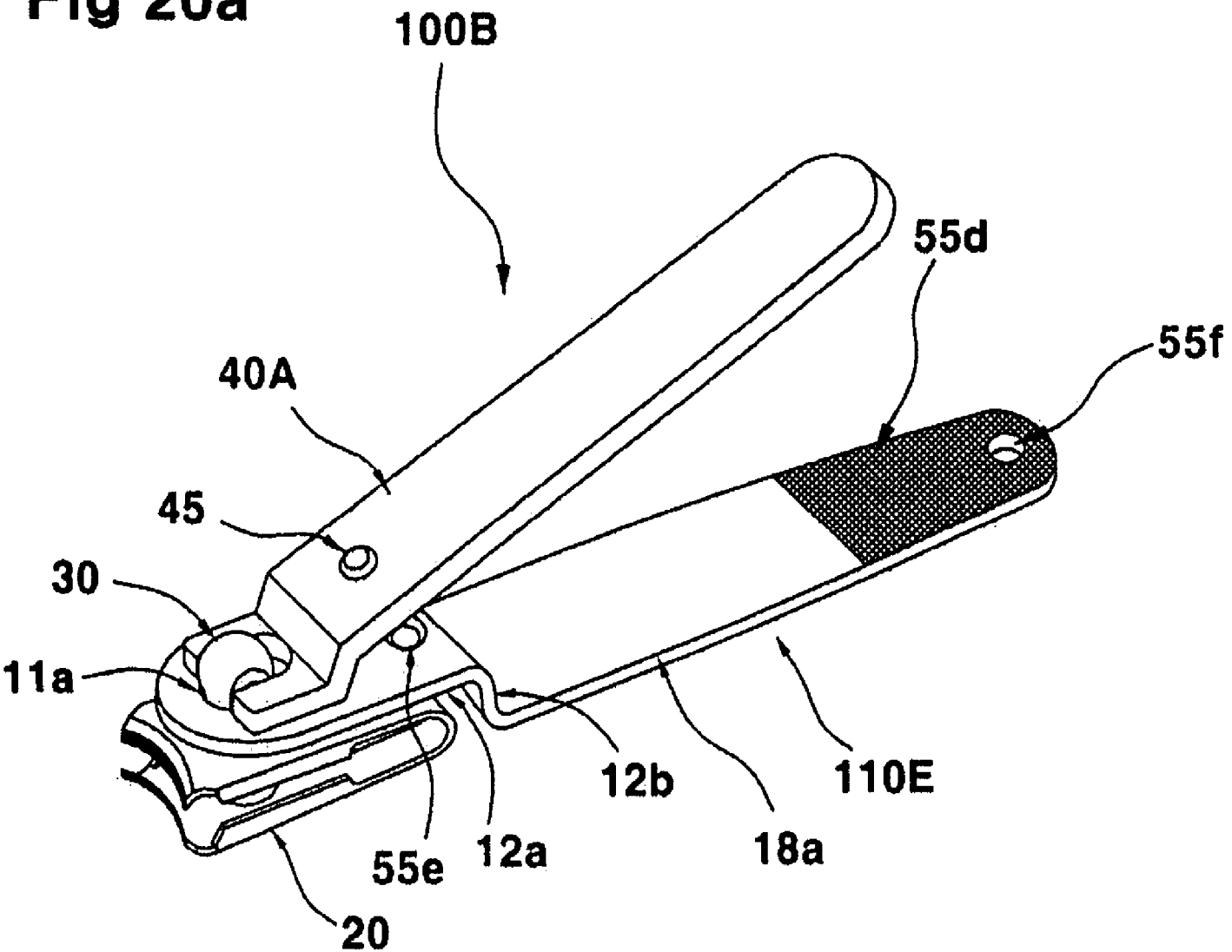
FIG. 20*a* is a view for showing the state of preparing for using modification of a nail clipper body of the invention.
Figure 20B:
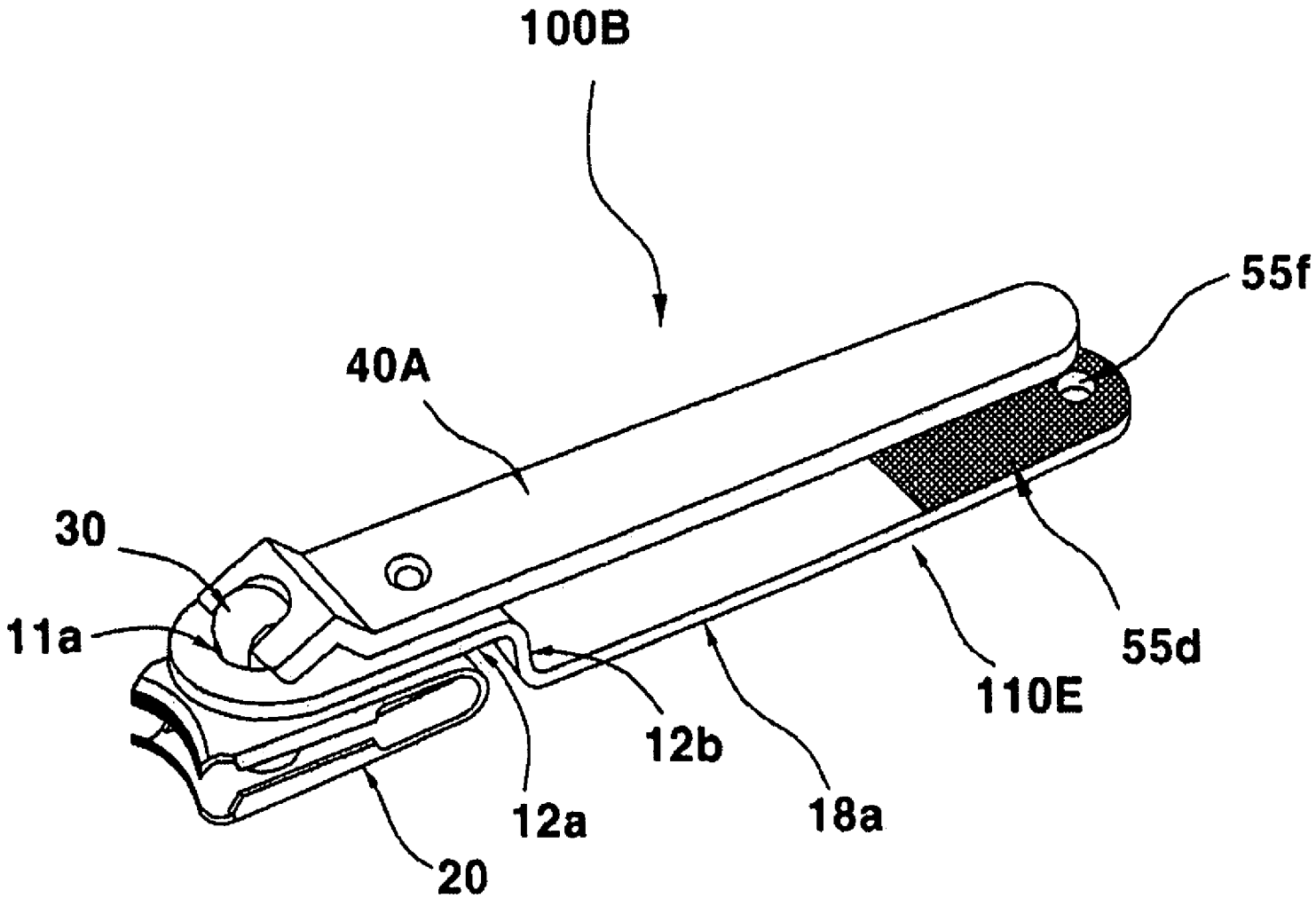
FIG. 20*b* is a view for showing the state of before using the modification shown in FIG. 20*b*.

FIG. 20*a* is a view for showing the state of preparing for using modification of a nail clipper body of the invention, and FIG. 20*b* is a view for showing the state of before using the modification shown in FIG. 20*b*.

According to a nail clipper 100B, a lever 40A made of metal is positioned on an upper side of a nail clipper body 110E, and the nail cutter 20 is positioned on a lower side 12*b* of the nail clipper body 110E, whereby, the cutter 20 is rotated at a time within a range of 360° without interference of an obstacle, when the cutter 20 is rotated centering around the supporting shaft 30 with a completely opened state.

The nail clipper body 110E is made of a plate-shaped metal member. The body 110E is bent downwardly at a predetermined distance from the supporting shaft hole 11*a* formed on a plain surface of one side thereof to rotatably receive the nail cutter. The body 110E is formed with a finger gripping part 18*a* horizontally bent and extended with having a step height 12*a* from the plain surface of the one side.

The numeral 55*d* designates a nail file, the numeral 55*e* designates a position groove, the numeral 45 designates a position projection for fixing a lever 40A to the position groove 55*e* upon keeping the nail clipper, and the numeral 55*f* designates a ring hole.

The nail clipper 100B shown in FIG. 20*a* is totally made of metal. A design for the nail clipper 100B is simplified with maintaining the rotation function of the nail cutter 20.

INDUSTRIAL APPLICABILITY

From the foregoing, according to the nail clipper exemplary embodiments of the invention, when rotating the cutter centering around the supporting shaft, a user directly grips a lower end of the nail cutter without an interference of an obstacle and easily rotates the cutter according to using direction. Further, the cutter is prevented from being rotated together with the lever upon rotating the lever, the cutter is prevented from being freely rotated in use, and the cutter is rotated right and left according to each step, whereby the user can cut nails conveniently at a desired angle.

Especially, since the nail cutter is made using a thin material, the material cost of the cutter can be considerably reduced. Further, since the life span of the pressing machine for working the cutter is increased, a cost reduction due to a mass production is possible. Furthermore, since the nail clipper made by bending the upper and lower cutters provides a flexible elasticity and prevents a stress concentration, a breakage of the bent center part of the cutter is prevented. Also, since reinforcing ribs are formed at both sides of the upper and lower cutters, a loss of cutting force of the cutter is restrained, and, additionally, the scattering of the trimmed nail is prevented.

Meanwhile, the assembly of the lever and the supporting shaft is simple, and since the supporting shaft of the lever is connected to both projection shafts, the projection shaft is not widened, and the lever is not separated from the supporting shaft, whereby an endurance of the product is considerably enhanced.

Further, according to the assembling process of the invention, to begin with, the head part of the supporting shaft is engaged with the projection shaft of the lever. Then, the supporting shaft is fitted into the supporting shaft holes of the body and the cutter. Then, if the wedge is inserted between the divided surfaces of the supporting shaft, the divided surfaces is widened, whereby the hooking jaw of the bottom part of the supporting shaft and the bottom surface of the cutter are hooked and coupled each other. Therefore, the assembly of the invention is very easy and secure, thereby removing a ground of inferiority of the product.

While a preferred embodiment of the invention has been described, it is to be understood that changes and variations may be made without departing the spirit or scope of the invention. Such changes and variations are intended to be within the scope of the invention and the appended claims.

What is claimed is:

1. A nail clipper comprising:

a rigid nail clipper body having a suitable length to grip, the nail clipper body having a supporting shaft hole at one side thereof;

a nail cutter having opposite cutting blades, and an upper cutter and a lower cutter facing each other, each having a supporting shaft hole adjacent to the cutting blades, respectively, and each having rigid and elastic properties; and a lever positioned on an upper side of the nail clipper body and connected with the nail cutter and the body through a supporting shaft to move the nail cutter by leverage;

wherein the lever is positioned on the upper side of the nail clipper body, and the nail cutter is positioned on a lower side of the nail clipper body, whereby the nail cutter is rotatable within a range of 360 degrees without interference of an obstacle, when the nail cutter is rotated centering around the supporting shaft with an unrestrained state.

2. The nail clipper according to claim 1, wherein the nail clipper body has a rigidity and a suitable length to grip, the body being integrally formed.

3. The nail clipper according to claim 1, the nail clipper body includes a base body made of a plate-shaped metal, the base body being assembled to a gripping body serving as a gripping part by slidably fitting to the gripping body.

4. The nail clipper according to claim 3, wherein one side of the base body is formed with a cutter rotation site at which the nail cutter is rotatably positioned, the supporting shaft hole being passed through the cutter rotation site, a click groove together with a projection site being formed around the supporting shaft hole, and the other side of the base body is formed with a stepped jaw, a protuberance and a hooking hole for engaging with the gripping body, the gripping body being formed with a guide groove for slidably inserting the base body and a fixing stepped jaw corresponding to the protuberance, a lower part of the guide groove being formed with a receiving part for receiving a nail handling tool at a predetermined height, a bottom surface of the gripping body being formed with an arch-shaped gripping part.

5. The nail clipper according to claim 1, the nail clipper body includes a base body made of a plate-shaped metal, the base body being assembled to a gripping body serving as a gripping part by inserting into the gripping body.

6. The nail clipper according to claim 1, the nail clipper body is made of a plate-shaped metal member, the body being bent downwardly at a predetermined distance from the supporting shaft hole formed on a plain surface of one side thereof to rotatably receive the nail cutter, the body being formed with a finger gripping part horizontally extended from a step height in the plain surface of the one side.

7. The nail clipper according to claim 1, wherein the nail clipper body is formed with a receiving part at a rear end thereof, a nail-handling tool being detachably mounted in the receiving part.

8. The nail clipper according to claim 1, wherein a nail handling tool is hinged to a rear end of the nail clipper body by way of opening and closing by horizontal rotation.

9. The nail clipper according to claim 1, wherein a nail handling tool is hinged to a rear end of the nail clipper body by way of opening and closing by up and down rotation.

10. The nail clipper according to claim 1, wherein the nail clipper body is formed with a gripping part rendering the finger to stably grip.

11. The nail clipper according to claim 1, wherein the nail clipper body is formed with a finger rim gripping part rendering the finger to stably grip.

12. The nail clipper according to claim 1, wherein the nail clipper body is formed with a cutter-projecting site around the supporting shaft hole formed on the one side thereof, at least one click groove being formed in the cutter-projecting site according to an angle, the upper cutter of the nail cutter being formed with a click projection corresponding to the click groove, whereby the nail cutter is rotated by a predetermined angle in the body and positioned for fixing to the body.

13. The nail clipper according to claim 1, wherein the nail cutter includes a rigid section and an elastic section, the elastic section including a breakage preventing and elastic flexible means for preventing a breakage of the nail cutter, and simultaneously for securing a flexible elastic property by dispersing a stress concentration due to pressing stress.

14. The nail clipper according to claim 13, wherein the breakage preventing and elastic flexible means forms an elongated hole so that a portion remaining from the elastic sections of the upper cutter and the lower cutter maintains the same width.

15. The nail clipper according to claim 14, the elongated hole further includes a connection supporter for preventing a twist.

16. The nail clipper according to claim 13, wherein the breakage preventing and elastic flexible means is constituted so that a portion remaining from the elastic sections of the upper cutter and the lower cutter maintains the same width, which is narrower than the width of the upper cutter and the lower cutter.

17. The nail clipper according to claim 13, wherein the breakage preventing and elastic flexible means is constituted so that the elastic section of the upper cutter and the lower cutter has a relatively thinner than that of the nail cutter of the rigid section, and has the same thin thickness within a predetermined range.

18. The nail clipper according to claim 13, wherein the upper cutter and the lower cutter include a reinforcing rib bent at a right angle on both side ends of the rigid section thereof to reinforce the rigidity of the nail cutter.

19. The nail clipper according to claim 13, wherein the upper cutter and the lower cutter include a reinforcing rib transformed by pressing edges of both side ends of the rigid section thereof to reinforce the rigidity of the nail cutter.

20. The nail clipper according to claim 1, wherein the upper cutter further includes at least one click projection projected adjacent to the supporting shaft hole on an upper surface thereof.

21. The nail clipper according to claim 1, wherein the upper cutter is covered with an upper cutter cover having a supporting shaft hole positioned in the same axis as the supporting shaft hole of the nail cutter, at least one click projection formed adjacent to the supporting shaft hole of the cover, and plates for preventing nails from scattering, which are formed by bending both side parts of the cover.

22. The nail clipper according to claim 1, wherein the lower cutter is covered with a lower cutter cover having a supporting shaft hole positioned in the same axis as the supporting shaft hole of the lower cutter, plates for preventing nails from scattering in the side direction, which are formed in both side parts of the cover, and a plate for preventing nails from scattering in the rear direction, which is formed in a rear part of the cover.

23. The nail clipper according to claim 1, wherein a washer is installed between the nail clipper body and the nail cutter.

24. The nail clipper according to claim 1, wherein the supporting shaft is characterized in that a head part is formed in one end thereof, the head part having a hole in the center thereof, in that a pair of posts are formed by being divided and longitudinally extended from the hole to both directions, in that a wedge hooking projection is formed on the respective divided surface of the post, in that a hooking jaw is formed to be projected outside at a lower end thereof, and in that the supporting shaft comprises a wedge having a hooking hole for engaging with the wedge hooking projection by fitting between the divided surfaces.

25. The nail clipper according to claim 1, wherein the lever includes a concave part on one end of the lever, and on opposite surfaces of the concave part are located respective projecting shafts and a supporting shaft having a stepped portion connecting the projecting shafts for preventing the projecting shafts from becoming further separated, and wherein the lever also includes a lever fulcrum part located adjacent to the concave part, and a pressing part located on the other side of the lever.

26. A nail cutter comprising:

opposite cutting blades formed on one side end thereof; and an upper cutter and a lower cutter facing each other, each having a supporting shaft hole adjacent to the cutting blades, respectively, and each having a rigid section and an elastic section;

the rigid section having a reinforcing means having a predetermined length at both side ends of the nail cutter and preventing the nail cutter from getting bent by transformation through bending or pressing so that a force pressed to the nail cutter is transferred into a cutting force without loss of force;

the elastic section having a breakage preventing and elastic flexible means for preventing breakage of the nail cutter and simultaneously for by dispersing a stress concentration due to pressing stress, wherein the upper cutter further includes at least one click projection projecting adjacent to the supporting shaft hole on an upper surface thereof.

27. The nail cutter according to claim 26, wherein the breakage preventing and elastic flexible means forms an elongated hole so that a portion remaining from the elastic sections of the upper cutter and the lower cutter maintains the same width.

28. The nail cutter according to claim 26, wherein the breakage preventing and elastic flexible means is constituted so that a portion remaining from the elastic sections of the upper cutter and the lower cutter maintains the same width, which is narrower than the width of the upper cutter and the lower cutter.

29. The nail cutter according to claim 26, wherein the upper cutter and the lower cutter include a reinforcing rib bent at a right angle on both side ends of the rigid section thereof to reinforce the rigidity of the nail cutter.

30. The nail cutter according to claim 26, wherein the upper cutter and the lower cutter include a reinforcing rib transformed by pressing on both side ends of the rigid section thereof to reinforce the rigidity of the nail cutter.

31. A nail cutter comprising:

opposite cutting blades formed on one side end thereof; and an upper cutter and a lower cutter facing each other, each having a supporting shaft hole adjacent to the cutting blades, respectively, and each having a rigid section and an elastic section by bending the other side thereof;

the rigid section having a reinforcing means having a predetermined length at both side ends of the nail cutter and preventing the cutter from getting bent by transformation through bending or pressing so that a force pressed to the nail cutter is transferred into a cutting force without loss of force;

the elastic section having a breakage preventing and elastic flexible means for preventing a breakage of the nail cutter and simultaneously for by dispersing a stress concentration due to pressing stress, wherein the breakage preventing and elastic flexible means forms an elongated hole so that a portion remaining from the elastic sections of the upper cutter and the lower cutter maintains the same width, and wherein the elongated hole further includes a connection supporter for preventing a twist.

32. A nail cutter comprising:

opposite cutting blades formed on one side end thereof; and an upper cutter and a lower cutter facing each other, each having a supporting shaft hole adjacent to the cutting blades, respectively, and each having a rigid section and an elastic section by bending the other side thereof;

the rigid section having a reinforcing means having a predetermined length at both side ends of the nail cutter and preventing the nail cutter from getting bent by transformation through bending or pressing so that a force pressed to the nail cutter is transferred into a cutting force without loss of force;

the elastic section having a breakage preventing and elastic flexible means for preventing breakage of the nail cutter and simultaneously for by dispersing a stress concentration due to pressing stress, wherein the breakage preventing and elastic flexible means is constituted so that the elastic section is relatively thinner than the rigid section, and has the same thin thickness within a predetermined range.

33. A lever for a nail clipper includes a concave part on one end of the lever, and on opposite surfaces of the concave part are located respective projecting shafts and a supporting shaft having a stepped portion connecting the projecting shafts for preventing the projecting shafts from becoming further separated, and wherein the lever a lever fulcrum part located adjacent to the concave part, and a pressing part located on the other side of the lever.

34. A supporting shaft for a nail clipper characterized in that a head part is formed in one end thereof, the head part having a hole in the center thereof, in that a pair of spaced apart posts extend longitudinally from the head part and away from the, in that a wedge hooking projection is formed on an inner surface of a respective one of the posts, in that a hooking jaw is formed at an end of the respective post opposite the, and in that the supporting shaft comprises a wedge having a hooking hole for engaging with the wedge hooking projection by fitting between the inner surfaces.

* * * * *